US009454126B2

(12) United States Patent
Mitani et al.

(10) Patent No.: US 9,454,126 B2
(45) **Date of Patent: *Sep. 27, 2016**

(54) CLEANING DEVICE AND IMAGE FORMING APPARATUS INCLUDING SAME

(71) Applicant: RICOH COMPANY, LTD., Tokyo (JP)

(72) Inventors: Yusuke Mitani, Kanagawa (JP); Kenji Sugiura, Kanagawa (JP); Yuuji Wada, Kanagawa (JP); Kazuki Yogosawa, Tokyo (JP); Junpei Fujita, Kanagawa (JP); Seiichi Kogure, Kanagawa (JP); Naohiro Kumagai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,202

(22) Filed: Feb. 23, 2016

(65) Prior Publication Data

US 2016/0170365 A1 Jun. 16, 2016

Related U.S. Application Data

(63) Continuation of application No. 14/638,425, filed on Mar. 4, 2015, now Pat. No. 9,329,533.

(30) Foreign Application Priority Data

Mar. 12, 2014 (JP) ..... 2014-048670

(51) Int. Cl.
*G03G 15/16* (2006.01)
*G03G 21/10* (2006.01)

(52) U.S. Cl.
CPC ..... *G03G 21/10* (2013.01); *G03G 15/161* (2013.01)

(58) Field of Classification Search
CPC ..... G03G 15/161
See application file for complete search history.

(56) References Cited

U.S. PATENT DOCUMENTS

| | | | |
|---|---|---|---|
| 9,213,271 | B2 | 12/2015 | Wada et al. |
| 2011/0103822 | A1 | 5/2011 | Sugiura et al. |
| 2011/0158677 | A1 | 6/2011 | Kikuchi et al. |
| 2011/0229187 | A1 | 9/2011 | Hozumi et al. |
| 2011/0229234 | A1 | 9/2011 | Hozumi et al. |

(Continued)

FOREIGN PATENT DOCUMENTS

| | | |
|---|---|---|
| JP | 2002-202702 | 7/2002 |
| JP | 2007-025173 | 2/2007 |
| JP | 2011-133664 | 7/2011 |

OTHER PUBLICATIONS

European Search Report dated Aug. 28, 2015 for European Patent Application No. 15158174.1.

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

A cleaning device includes a plurality of cleaners. The plurality of cleaners includes at least a first cleaner, a second cleaner, and a third cleaner arranged next to each other in a traveling direction of a cleaning target. The first cleaner is disposed at an extreme upstream end of the traveling direction and supplied with a first voltage having a same polarity as a polarity of a normally-charged toner. The cleaners, other than the first cleaner, disposed downstream from the first cleaner, is supplied with a second voltage having a polarity opposite the polarity of the normally-charged toner.

10 Claims, 7 Drawing Sheets

(56) References Cited

U.S. PATENT DOCUMENTS

2012/0008973 A1 1/2012 Sakakibara et al.
2012/0034006 A1 2/2012 Asaoka et al.
2012/0087704 A1 4/2012 Asaoka et al.
2012/0099883 A1 4/2012 Kikuchi et al.
2012/0224870 A1* 9/2012 Kikuchi ..... G03G 15/161 399/44
2013/0142539 A1 6/2013 Komiyama et al.
2013/0315617 A1 11/2013 Sugiura et al.
2014/0064769 A1 3/2014 Sugiura et al.
2014/0178090 A1 6/2014 Nakamura
2014/0314461 A1 10/2014 Ishizuka et al.
2014/0321874 A1 10/2014 Sugiura et al.
2015/0261137 A1* 9/2015 Mitani ..... G03G 15/161 399/101

* cited by examiner

CLEANING DEVICE AND IMAGE FORMING APPARATUS INCLUDING SAME

CROSS-REFERENCE TO RELATED APPLICATIONS

This patent application is a continuation of U.S. patent application Ser. No. 14/638,425, filed Mar. 4, 2015, which is based on and claims priority pursuant to 35 U.S.C. §119 to Japanese Patent Application No. 2014-048670, filed on Mar. 12, 2014, in the Japan Patent Office, the entire disclosures of each of which are hereby incorporated by reference herein.

BACKGROUND

1. Technical Field

Exemplary aspects of the present disclosure generally relate to a cleaning device and an image forming apparatus including same.

2. Description of the Related Art

Cleaning devices that use electrostatic force to remove residual toner from an intermediate transfer belt of an image forming apparatus after transfer are known. However, cleaning ability of such cleaning devices depends on toners. In view of the above, there is demand for a cleaning device capable of cleaning toner regardless of types of toner.

SUMMARY

In view of the foregoing, in an aspect of this disclosure, there is provided a novel cleaning device including a plurality of cleaners. The plurality of cleaners includes at least a first cleaner, a second cleaner, and a third cleaner arranged next to each other in a traveling direction of a cleaning target. The first cleaner is disposed at an extreme upstream end of the traveling direction and supplied with a first voltage having a same polarity as a polarity of a normally-charged toner. The cleaners other than the first cleaner, disposed downstream from the first cleaner, is supplied with a second voltage having a polarity opposite the polarity of the normally-charged toner.

According to another aspect, an image forming apparatus includes a first image bearer, a toner-image forming device, a transfer device, and the cleaning device. The first image bearer bears a toner image and a test toner pattern on a surface thereof, and travels in a traveling direction. The toner-image forming device forms the toner image and the test toner pattern on the surface of the first image bearer. The transfer device transfers the toner image from the first image bearer onto a recording medium. The cleaning device removes residual toner adhered to the surface of the first image bearer.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
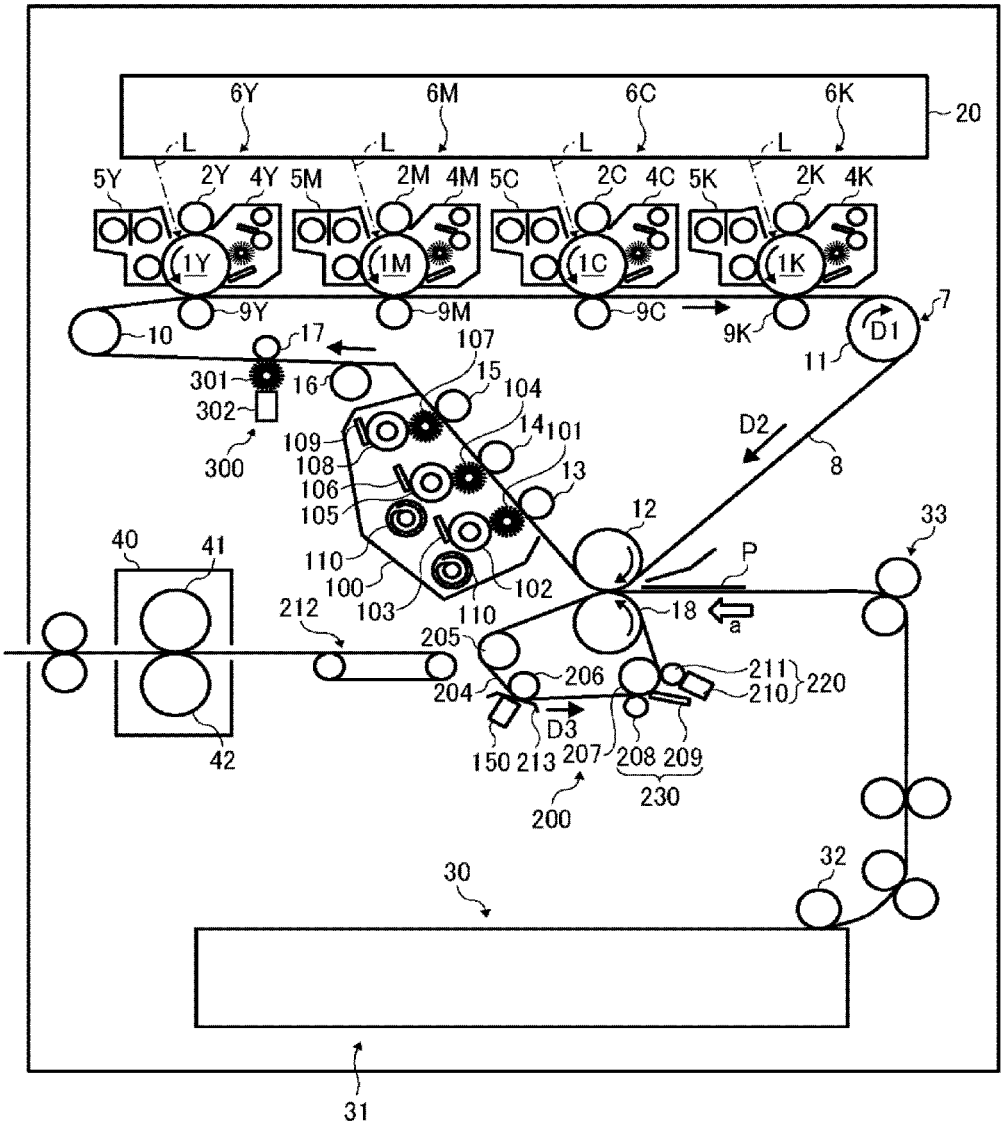
FIG. 1 is a schematic diagram illustrating a printer as an example of an image forming apparatus according to illustrative embodiments of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

In order to facilitate an understanding of the novel features of the present invention, as a comparison, a description is provided of a known cleaning device.

Cleaning devices that use electrostatic force to remove residual toner from an intermediate transfer belt of an image forming apparatus after transfer are known.

Specific examples of such cleaning devices include a cleaning device in which three cleaning brush rollers serving as cleaners are arranged side by side in a traveling direction of an intermediate transfer belt. One of the three cleaning brush rollers, which is arranged at the extreme upstream side relative to the traveling direction of the intermediate transfer belt, hereinafter referred to as a first cleaning brush roller, is supplied with a voltage having a positive polarity in order to roughly and electrostatically remove normally-charged toner having a negative polarity from the intermediate transfer belt.

The second cleaning brush roller, which is disposed downstream from the first brush roller in the traveling direction of the intermediate transfer belt, is supplied with voltage having a negative polarity to electrostatically remove reversely charged toner remaining on the intermediate transfer belt. Lastly, the third cleaning brush roller, which is disposed at the extreme downstream end in the traveling direction of the intermediate transfer belt, downstream from the second cleaning brush roller, is supplied with a voltage having a positive polarity to remove the normally-charged toner on the intermediate transfer belt.

However, cleanability of such cleaning devices depends on toners. Thus, there is demand for a cleaning device capable of cleaning toner regardless of types of toner.

Referring now to the drawings, wherein like reference numerals designate identical or corresponding parts throughout the several views, exemplary embodiments of the present patent application are described.

With reference to FIG. 1, a description is provided of a tandem-type printer using an intermediate transfer method as an example of an image forming apparatus according to an illustrative embodiment of the present disclosure.

FIG. 1 is a schematic diagram illustrating a printer as an example of an image forming apparatus according to illustrative embodiments of the present disclosure.

The image forming apparatus includes four process units 6Y, 6M, 6C, and 6K that form toner images of yellow, magenta, cyan, and black, respectively. The process units 6Y, 6M, 6C, and 6K include drum-shaped photoconductors 1Y, 1M, 1C, and 1K, respectively. Charging devices 2Y, 2M, 2C, and 2K, developing devices 5Y, 5M, 5C, and 5K, drum cleaning devices 4Y, 4M, 4C, and 4K, and charge removers are respectively disposed around the photoconductors 1Y, 1M, 1C, and 1K. The process units 6Y, 6M, 6C, and 6K all have the same configuration as all the others, differing only in the color of toner employed.

It is to be noted that the suffixes Y, M, C, and K denote colors yellow, magenta, cyan, and black, respectively. To simplify the description, the suffixes Y, M, C, and K indicating colors are omitted herein, unless otherwise specified.

An optical writing unit 20 that irradiates the photoconductors 1Y, 1M, 1C, and 1K with laser light L is disposed above the process units 6Y, 6M, 6C, and 6K.

A transfer unit 7 is disposed below the process units 6Y, 6M, 6C, and 6K. The transfer unit 7 includes an intermediate transfer belt 8 serving as an image bearer. The intermediate transfer belt 8 is formed into an endless loop. The transfer unit 7 further includes a plurality of tension rollers disposed inside the loop of the intermediate transfer belt 8, and a secondary transfer device 200, a tension roller 16, a belt cleaning device 100, a lubricant applicator 300, which are disposed outside the loop of the intermediate transfer belt 8.

Inside the loop of the intermediate transfer belt 8, four primary transfer rollers 9Y, 9M, 9C, and 9K, a driven roller 10, a drive roller 11, a secondary-transfer opposed roller 12, three cleaning opposed rollers 13, 14, and 15, and an application-brush opposed roller 17 are disposed. The intermediate transfer belt 8 is entrained around these rollers and stretched taut. These rollers function as tension rollers. The cleaning opposed rollers 13, 14, and 15 do not necessarily apply a tension to the intermediate transfer belt 8 and may be driven to rotate along with rotation of the intermediate transfer belt 8. The drive roller 11 is driven to rotate counterclockwise in FIG. 1 by a driving device such as a motor, and the intermediate transfer belt 8 is driven to endlessly move counterclockwise in FIG. 1 by the rotation of the drive roller 11.

The intermediate transfer belt 8 is interposed between the primary transfer rollers 9Y, 9M, 9C, and 9K disposed inside the looped intermediate transfer belt 8 and the photoconductors 1Y, 1M, 1C, and 1K. Accordingly, primary transfer nips are formed between the front surface (image bearing surface) of the intermediate transfer belt 8 and the photoconductors 1Y, 1M, 1C, and 1K contacting the intermediate transfer belt 8. A primary transfer bias having a polarity opposite that of toner is applied from a power source to the primary transfer rollers 9Y, 9M, 9C, and 9K.

The secondary transfer device 200 disposed outside the looped intermediate transfer belt 8 includes a secondary transfer roller 18, a separation roller 205, an optical-detector opposed roller 206, a cleaning opposed roller 207, and a secondary transfer belt 204 serving as a transfer member as well as a second image bearer. Outside the loop formed by the secondary transfer belt 204, an optical detector unit 150, a secondary transfer cleaning device 230, and a lubricant applicator 220 are disposed. The optical detector unit 150 is disposed opposite to the optical-detector opposed roller 206 via the secondary transfer belt 204. The secondary transfer cleaning device 230 includes a cleaning brush 208 and a cleaning blade 209 which contact the secondary transfer belt 204 entrained about the cleaning opposed roller 207.

The lubricant applicator 220 includes a lubricant 210 and an application brush 211. The application brush 211 contacts the secondary transfer belt 204 entrained about the cleaning opposed roller 207 and downstream from the cleaning blade 209 in the traveling direction of the secondary transfer belt 204.

A shutter 213 is disposed between the optical detector unit 150 and the secondary transfer belt 204 to prevent an optical element of the optical detector unit 150 from getting contaminated by toner when the optical detector unit 150 does not operate. The shutter 213 is turned on and off by a motor. According to the present illustrative embodiment, the shutter 213 is a mechanical shutter. Alternatively, the shutter may be a combination of an air shutter or the like.

The lubricant 210 to be applied to the surface of the secondary transfer belt 204 is formed of a fatty acid metal salt having a linear hydrocarbon chain. The fatty acid metal salt includes fatty acid including at least one of stearic acid, palmitic acid, myristic acid, and oleic acid, and metal including at least one of zinc, aluminum, calcium, magnesium, and lithium. In particular, zinc stearate is preferable because zinc stearate is mass-produced in an industrial scale and has been used successfully. In other words, the zinc stearate is most preferable because of its cost, stable quality, and reliability. The fatty acid metal salt is not limited to a combination of a fatty acid and a metal salt. Alternatively, other suitable combination of fatty acids and metal salts may be used. Furthermore, the fatty acid metal salts may contain metal oxide and free fatty acid.

The lubricant 210 is supplied to the surface of the secondary transfer belt 204 little by little in a powder form by the application brush 211. More specifically, the application brush 211 scrapes the lubricant 210 in solid form. Another method in which the lubricant is applied to the secondary transfer belt 204 includes, but is not limited to, adding a lubricating agent to toner which is then adhered to the secondary transfer belt 204 at predetermined timing. However, in this case, the amount of supply depends on an image area of an output image. Thus, the lubricant cannot be applied to an entire belt surface.

In view of the above, when supplying the lubricant 210 to the entire surface of the secondary transfer belt 204 by a simple structure, the application brush 211 that scrapes the lubricant 210 in solid form is suitable such as in the present illustrative embodiment.

In order to scrape the lubricant 210 by the application brush 211, the lubricant 210 is pressed against the application brush 211 by a pressing member such as an elastic member, for example, a spring.

The intermediate transfer belt 8 and the secondary transfer belt 204 are interposed between the secondary transfer opposed roller 12 disposed inside the looped intermediate transfer belt 8 and the secondary transfer roller 18. The place where the peripheral surface of the intermediate transfer belt 8 and the secondary transfer belt 61 contact is a so-called a secondary transfer nip. A secondary transfer bias having a polarity opposite that of toner is applied from a power source to the secondary-transfer opposed roller 12.

The secondary transfer roller 18 is rotated counterclockwise by a drive source such as a drive motor in FIG. 1, thereby enabling the secondary transfer belt 204 to travel in the direction indicated by an arrow D3. A pulse motor or the like may be employed as the drive motor of the secondary transfer roller 18 as long as the linear velocity of the secondary transfer belt 204 can be changed upon forming a test toner pattern and upon outputting the image. The linear velocity can be changed by adjusting the pulse number per input time when using a pulse motor.

When using a direct-current motor, an input voltage or the like is adjusted. In this case, the number of revolutions of one of the separation roller 205 which is a driven roller, the optical-detector opposed roller 206, and the cleaning opposed roller 207 is detected and feedback-controlled, thereby maintaining accuracy of the linear velocity of the secondary transfer belt 204.

The intermediate transfer belt 8 is interposed between the cleaning opposed rollers 13, 14, and 15, and a first cleaning brush roller 101 serving as a first cleaner, a second cleaning brush roller 104 serving as a second cleaner, and a third cleaning brush roller 107 serving as a third cleaner, respectively. Accordingly, cleaning nips are formed at places where the first through third cleaning brush rollers 101, 104, and 107 contact the front surface of the intermediate transfer belt 8. The belt cleaning device 100 is replaceable together with the intermediate transfer belt 8. In a case in which the belt cleaning device 100 and the intermediate transfer belt 8 have different product life cycles, the belt cleaning device 100 may be detachably attachable relative to the main body of the image forming apparatus, independent of the intermediate transfer belt 8. A detailed description of the belt cleaning device 100 will be provided later.

The image forming apparatus of the present illustrative embodiment includes a paper feed unit 30 equipped with a paper cassette 31 and a feed roller 32. The paper cassette 31 stores a stack of recording media P. The feed roller 32 feeds the recording media P to a sheet passage. A pair of registration rollers 33 is disposed on the right side of the secondary transfer nip in FIG. 1. The pair of registration rollers 33 receives the recording medium P from the paper feed unit 30 and feeds it toward the secondary transfer nip at predetermined timing.

A fixing device 40 is disposed on the left side of the secondary transfer nip in FIG. 1 and includes a heating roller 41 and a pressing roller 42. The fixing device 40 receives the recording medium P bearing a toner image thereon from the secondary transfer nip and fixes the toner image on the recording medium P with heat and pressure applied by the heating roller 41 and the pressing roller 42. In some embodiments, the image forming apparatus optionally includes toner supply devices that supply toners of yellow, magenta, cyan, and black to the respective developing devices 5Y, 5M, 5C, and 5K, if necessary.

In addition to normal paper, for example, special paper having an embossed surface or paper used for thermal transfer such as iron print may be used for the recording medium P. Improper transfer of color toner images superimposed one atop the other may occur more easily when transferring the toner images from the intermediate transfer belt 8 onto such special paper as compared with transferring the toner images onto normal paper.

In view of the above, the intermediate transfer belt 8 includes an elastic layer with relatively low hardness on the surface that forms the transfer nip, thereby enabling the intermediate transfer belt 8 to deform in accordance with toner layers and recording media with a relatively rough surface.

The low-hardness elastic layer on the surface of the intermediate transfer belt 8 can deform in accordance with the rough surface. With this configuration, the intermediate transfer belt 8 can closely contact the toner layer without applying an excessive transfer pressure and can uniformly transfer the toner layer even onto a rough-surface recording medium, hence preventing toner dropouts (blank spots).

According to the present illustrative embodiment, the intermediate transfer belt 8 includes, preferably, a base layer, an elastic layer on the base layer, and a surface coating layer disposed on the elastic layer.

Examples of materials used for the elastic layer of the intermediate transfer belt 31 include, but are not limited to elastic members such as elastic material rubber and elastomer.

Specific preferred materials suitable for the elastic layer include, but are not limited to, elastic rubbers and elastomers, such as butyl rubber, fluorine-based rubber, acrylic rubber, Ethylene Propylene Diene Monomer (EPDM), nitrile butadiene (NBR), acrylonitrile-butadiene-styrene rubber, natural rubber, isoprene rubber, styrene-butadiene rubber, butadiene rubber, urethane rubber, syndiotactic 1,2-polybutadiene, epichlorohydrin rubber, polysulfide rubber, polynorbornene rubber, and thermoplastic elastomers. These materials can be used alone or in combination.

Depending on the hardness and the layer structure of the elastic layer, the elastic layer preferably has a thickness of 0.07 mm to 0.6 mm, more preferably 0.25 to 0.5 mm. When the thickness of the intermediate transfer belt 8 is small such as 0.07 mm or less, the pressure to the toner on the intermediate transfer belt 8 increases in the secondary transfer nip, and image defects such as toner dropouts (blank spots) occur easily during transfer. Consequently, the transferability of the toner is degraded.

Preferably, the hardness of the elastic layer is 10°≤HS≤65° in accordance with Japanese Industrial Standards (JIS-A). The optimum hardness differs depending on the layer thickness of the intermediate transfer belt 8. When the hardness is lower than 10° JIS-A, toner dropouts occur easily during transfer. By contrast, when the hardness is higher than 65° JIS-A, the belt is difficult to entrain around the rollers. Furthermore, the durability of such a belt with the hardness higher than 65° JIS-A is poor because the belt is stretched taught for an extended period of time, causing frequent replacement of the belt.

The base layer of the intermediate transfer belt 8 is formed of relatively inelastic resin. More specifically, examples of materials used for the base layer of the intermediate transfer belt 8 include, but are not limited to, copolymers such as polycarbonate, styrene-butadiene copolymer, styrene-vinyl chloride copolymer, styrene-vinyl acetate copolymer, and resin such as fluorocarbon resin, phenol resin, epoxy resin, polyester resin, and polyurethane resin. These materials can be used alone or in combination.

To prevent overstretching of the elastic layer made of a rubber material that easily stretches, a core layer made of a material such as canvas may be disposed between the base layer and the elastic layer.

Materials suitable for the core layer include, but are not limited to, natural fibers (e.g., cotton, silk), synthetic fibers (e.g., polyester fiber, nylon fiber, acrylic fiber), inorganic fibers (e.g., carbon fiber, glass fiber), and metal fibers (e.g., iron fiber, copper fiber). These materials can be used alone or in combination. These materials are used after being formed into yarn or woven cloth.

The coating layer of the surface of the intermediate transfer belt 8 provides a smooth surface that covers the surface of the elastic layer.

Any material can be used for the coating layer. However, materials that can enhance the transferability of the secondary transfer through reducing adhesion force of the toner onto the surface of the intermediate transfer belt 8 are generally used. For example, one or more of polyurethane resin, polyester resin, epoxy resin, and so forth can be used.

Alternatively, one or more of particulate materials having low surface energy while providing good lubricity such as fluorine-containing resins, fluorine compounds, carbon fluoride, titanium oxide, and silicon carbide, can be dispersed in the coating layer. If desired, particulate materials having different particle diameters are dispersed in the coating layer. The coating layer may also be a fluorine-containing layer formed through thermal treatment of a fluorine-based rubber, thereby reducing the surface energy of the layer.

In order to adjust the resistance of the base layer, the elastic layer, and the coating layer, these layers may contain powder of metals and conductive metal oxide. Powder of metals includes, but is not limited to, carbon black, graphite, aluminum, and nickel.

The conductive metal oxide include, but are not limited to, tin oxide, titanium oxide, antimony oxide, indium oxide, potassium titanate, antimony-tin composite oxide (ATO), and indium tin composite oxide (ITO)

The conductive metal oxides may be covered with insulative fine particles such as barium sulfate, magnesium silicate, and calcium carbonate, for example.

The image forming apparatus of the present illustrative embodiment includes a lubricant applicator 300 to apply a lubricating agent on the surface of the intermediate transfer belt 8 to protect the surface thereof. However, the image forming apparatus does not necessarily include the lubricant applicator 300 depending on a choice of toner, choice of the material of the intermediate transfer belt 8, and the friction coefficient of the surface of the intermediate transfer belt 8. The lubricant applicator 300 includes a brush roller 301 to contact and scrape a block (solid) lubricant 302 while the brush roller rotates. The lubricant in powder form thus obtained is applied to the surface of the intermediate transfer belt 8.

Next, a description is provided of an image forming operation of the image forming apparatus according to the illustrative embodiment of the present disclosure.

When receiving image information from a personal computer (PC) or the like, the drive roller 11 of the transfer unit 7 is driven to rotate in a direction of arrow D1 in FIG. 1 by a controller, thereby moving the intermediate transfer belt 8 in a direction of arrow D2 at a constant speed. The rollers other than the drive roller 11 around which the intermediate transfer belt 8 is entrained are rotated in conjunction with rotation of the intermediate transfer belt 8.

A main motor drives the photoconductors 1Y, 1M, 1C, and 1K of the respective process units 6Y, 6M, 6C, and 6K to rotate in a direction of arrow at a constant speed.

The surfaces of the photoconductors 1Y, 1M, 1C, and 1K are uniformly charged by the respective charging devices 2Y, 2M, 2C, and 2K. After the surfaces of the photoconductors 1Y, 1M, 1C, and 1K are charged, the photoconductors 1Y, 1M, 1C, and 1K are exposed to laser light L so that electrostatic latent images are formed on each of the photoconductors 1Y, 1M, 1C, and 1K.

The developing devices 5Y, 5M, 5C, and 5K develop the electrostatic latent images on the respective surfaces of the photoconductors 1Y, 1M, 1C, and 1K into respective toner images of yellow, magenta, cyan, and black. The toner images of yellow, magenta, cyan, and black are transferred onto an outer peripheral surface of the intermediate transfer belt 8 one atop the other in the respective primary transfer nips. Accordingly, a composite toner image, in which the toner images of yellow, magenta, cyan, and black are superimposed one atop the other, is formed on the outer peripheral surface of the intermediate transfer belt 8.

At the same time, in the paper feed unit 30, the feed roller feeds a sheet of recording medium P from the paper feed cassette 31 toward the pair of registration rollers 33. The recording medium P is transported until the leading end of the recording medium P is interposed between the pair of registration rollers 33. The pair of registration rollers 33 rotates to feed the recording medium P to the secondary transfer nip in the direction of arrow a in appropriate timing such that the recording medium P is aligned with the four-color composite toner image formed on the intermediate transfer belt 8 in the secondary transfer nip. Because an electrical field that causes the toner to move from the intermediate transfer belt 8 to the recording medium P is formed in the secondary transfer nip, the composite toner image on the intermediate transfer belt 8 is transferred onto the recording medium P when the recording medium P passes through the secondary transfer nip.

Thus, the composite full-color toner image is formed on the recording medium P. After the secondary transfer, the recording medium P is electrostatically absorbed to the secondary transfer belt 204 and carried thereon in the traveling direction of the secondary transfer belt 204. The recording medium P electrostatically adhering to the secondary transfer belt 204 separates from the secondary transfer belt 204 by self stripping at the separation roller 205 and is delivered to a belt conveyor 212. The conveyor belt 212 then carries the recording medium P and delivers to the fixing device 40. After the fixing process, the recording medium P, on which the toner image is fixed, is output by a pair of output rollers onto a catch tray outside the image forming apparatus.

After the toner images of yellow, magenta, cyan, and black are transferred primarily from the photoconductors 1Y, 1M, 1C, and 1K onto the intermediate transfer belt 8, the drum cleaning devices 4Y, 4M, 4C, and 4K remove residual toner remaining on the respective photoconductors 1Y, 1M, 1C, and 1K. Subsequently, static eliminators such as charge erasing lamps eliminate electric charges remaining on the photoconductors 1Y, 1M, 1C, and 1K. Then, the photoconductors 1Y, 1M, 1C, and 1K are again charged uniformly by the respective charging devices 2Y, 2M, 2C, and 2K in preparation for the subsequent imaging cycle.

After the composite toner image are transferred from the intermediate transfer belt 8 onto the recording medium P in the secondary transfer process, the belt cleaning device 100 removes residual toner remaining on the intermediate transfer belt 8 and the lubricant applicator 300 applies the lubricating agent to the intermediate transfer belt 8.

The cleaning brush 208 and the cleaning blade 209 clean the surface of the secondary transfer belt 204. The secondary transfer belt 204 employs a belt formed of widely-used polyimide. In normal image output, toner does not normally stick to the secondary transfer belt 204. However, there is a case in which a slight amount of toner sticks to the intermediate transfer belt 8 between successive recording media sheets and then sticks to the secondary transfer belt 204. Therefore, cleaning is necessary. According to the present illustrative embodiment, as will be described later, in order to adhere test toner patterns to the secondary transfer belt 204, the toner corresponding to the test toner patterns needs to be removed. Conditions for the cleaning brush 208 and the cleaning blade 209 that cleans the surface of the secondary transfer belt 204 are as follows.

[Cleaning Blade]

Cleaning blade pressure method: Pressure control method

Material: Polyurethane rubber (X002, manufactured by Bando Chemical Industries, Ltd.)

Contact angle: 83 degrees

Contact pressure: 0.23 N/cm

[Cleaning brush]

Material: Conductive acrylic brush (SA-7, manufactured by Toray Industries, Inc.)

Brush type: Straight bristles

Size: 330T/48F

Bristle density: 10000 to 60000/inch$^2$

Length: Approximately 4 mm

Brush revolution: 350 to 950 rpm

The cleaning brush 208 serves its purpose as long as the cleaning brush 208 is capable of dispersing the toner. The cleaning brush 208 can be used in forward and backward directions relative to the traveling direction of the secondary transfer belt 204.

Figure 2:
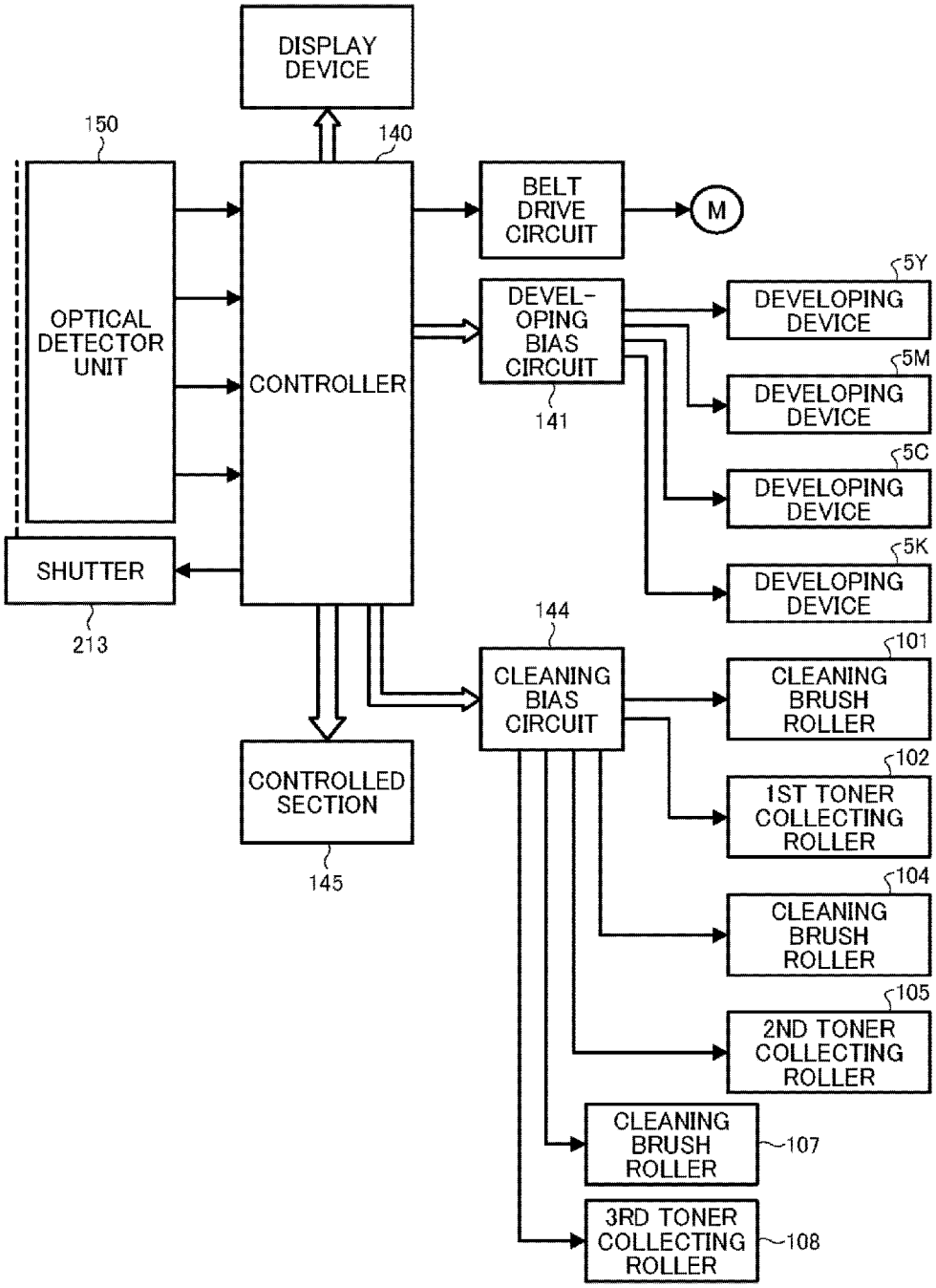
FIG. 2 is a control block diagram of the image forming apparatus shown in FIG. 1.

FIG. 2 is a control block diagram of the image forming apparatus shown in FIG. 1.

In FIG. 2, a controller 140 controls the entire image forming apparatus shown in FIG. 1. The controller 20 includes a microprocessor consisting of, for example, a central processing unit (CPU), a Read Only Memory (ROM), a Random Access Memory (RAM), and an input-output circuit, and so forth.

The controller 140 drives and controls each device shown in FIG. 1, to carry out image forming (printing, copying) processing with respect to a recording medium upon image formation as described above. The controller 140 operates various processing associated with adjustment of image density, correction of color shift, and a refresh mode with respect to the developing device upon application of power or at every predetermined printing operation, for example. Furthermore, the controller 140 controls a cleaning bias circuit 144 to supply later-described voltages to the cleaning brush rollers and the toner collecting rollers.

A description is now provided of adjustment of the image density.

Upon application of power or at every predetermined printing operation, image density adjustment is performed to optimize the image density for each color.

Figure 3:
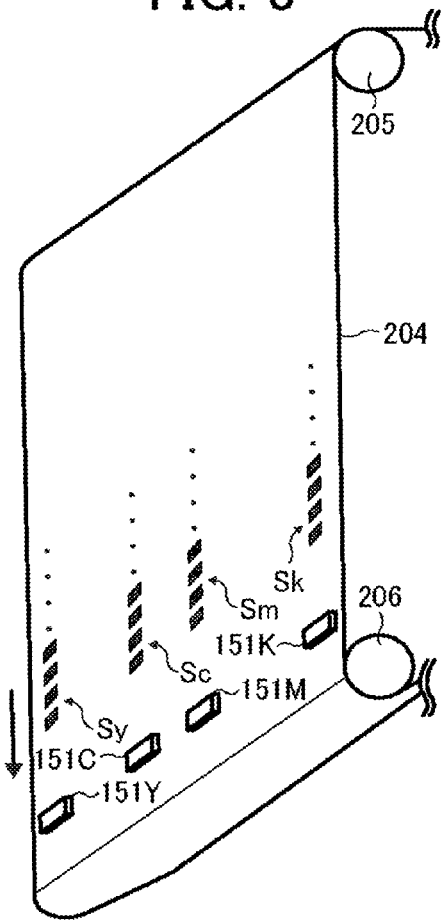
FIG. 3 is an enlarged schematic diagram illustrating a secondary transfer belt of the image forming apparatus, on which half tone patterns are formed, and optical detectors disposed in the vicinity of the secondary transfer belt.

In the image density adjustment, as illustrated in FIG. 3, initially, gradation patterns Sk, Sm, Sc and Sy as test toner patterns are automatically formed on the secondary transfer belt 204 at positions facing each of optical detectors 151K, 151M, 151C, and 151Y, respectively, as illustrated in FIG. 3. Each gradation pattern comprises ten toner patches each having a different image density and an area of 2 cm×2 cm. When forming gradation patterns Sk, Sm, Sc and Sy, the controller 140 adjusts the voltage to be supplied to the charging devices 2Y, 2M, 2C, and 2K in the controlled section 145. Then, the charge potentials of the photoconductors 1Y, 1M, 1C, and 1K are gradually increased, in contrast to the normal printing process in which the charge potentials are kept constant.

Subsequently, a plurality of electrostatic latent patches is formed on the photoconductors 1Y, 1M, 1C, and 1K by laser light scanning and then developed into toner patches by the developing devices 5Y, 5M, 5C, and 5K, respectively. When developing the electrostatic latent patches into toner patches, the controller 140 controls a developing bias circuit 141 to increase gradually the developing bias applied to the developing rollers. As a result, gradation patterns of yellow, magenta, cyan, and black are formed on the respective photoconductors 1Y, 1M, 1C, and 1K.

The gradation patterns are then secondarily transferred onto the secondary transfer belt 204 at a predetermined interval in the main scanning direction which coincides with a belt width direction. The weight of toner in the toner patch having the lowest image density is approximately 0.1 mg/cm$^2$, and the weight of toner in the toner patch having the highest image density is approximately 0.55 mg/cm$^2$. In addition, the polarity of the color toners is the same, and each of the toners has a normal Q/d (i.e., (charge quantity)/(diameter)) distribution.

The gradation patterns Sk, Sm, Sc, and Sy formed on the secondary transfer belt 204 pass the positions facing the respective optical detectors 151K, 151M, 151C, and 151K as the secondary transfer belt 204 endlessly moves. The optical detectors 151K, 151M, 151C, and 151K receive light in an amount corresponding to the amount of toner per unit area in each toner patch and output detection signals corresponding to the amount of light. The detection signals are provided to the controller 140.

Subsequently, the microcomputers of the controller 140 calculate the weight of toner in each toner patch based on the voltage of the detection signals provided by the optical detectors 151K, 151M, 151C, and 151K and a conversion algorithm. Imaging conditions are adjusted based on the calculated weight of toner.

More specifically, the relation between the toner weights of the toner patches and the development potentials in formation of the toner patches is graphed to obtain a function (y=ax+b) using a regression analysis method. By assigning a target image density to the function, a proper developing bias can be calculated. Thus, the developing biases for the developing devices 5Y, 5M, 5C and 5K can be determined. During image formation, the controller 140 controls the developing bias circuit 141 to adjust the developing bias voltages to be supplied to the developing rollers.

The memory of the controller 140 (such as ROM) stores an image forming condition data table showing the relation between several tens of the developing bias values and the potentials of the photoconductors. The developing bias, which is nearest to the above-determined developing bias, is selected from the data table for each of the process units 6Y, 6M, 6C and 6K, and the charge potential of the photoconductor of the process unit corresponding to the developing bias is determined. During image formation, the controller 140 controls voltages to be supplied to the charging devices 2Y, 2M, 2C, and 2K shown in FIG. 1 in the controlled section 145 to adjust the charge potentials of the photoconductors 1Y, 1M, 1C, and 1K to the specified charge potentials.

According to the present illustrative embodiment, the gradation patterns are detected on the secondary transfer belt 204. In this configuration, the gradation patterns are detected in a downstream process in the image formation process, as compared with a case in which the gradation patterns are formed and detected on the intermediate transfer belt. With this configuration, changes in the secondary transfer rate can be incorporated into the image density control, and imaging quality can be stabilized.

Next, a description is provided of correction of color shift.

Figure 4:
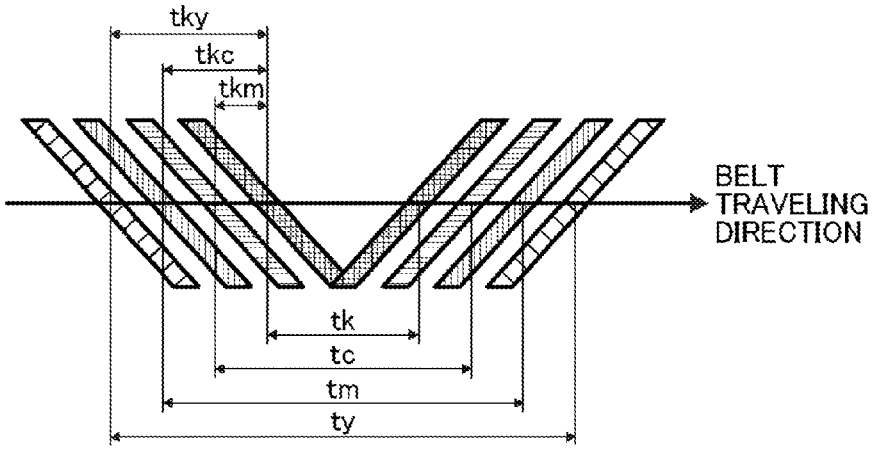
FIG. 4 is an enlarged schematic diagram illustrating a chevron patch formed on the secondary transfer belt of FIG. 3.

Upon application of power or at every predetermined printing operation, the controller 140 adjusts color shift. In the color shift correction, a chevron patch for detection of color shift, which is constituted of test toner patterns of yellow, magenta, cyan, and black as illustrated in FIG. 4, is formed on both end portions of the secondary transfer belt 204 in the width direction thereof. The chevron patch includes Y, M, C and K line toner patterns which are slanted by approximately 45° relative to the main scanning direction and are arranged at predetermined intervals in the traveling direction of the belt (i.e., the sub-scanning direction). The weight of toner in the chevron patch is approximately 0.3 $mg/cm^2$.

When the test toner patterns in the chevron patches formed on both ends of the secondary transfer belt 204 in the width direction are detected, the position of each toner pattern in the main scanning direction (i.e., the axial direction of the photoconductor) and the sub-scanning direction (i.e., the traveling direction of the secondary transfer belt 204), error in magnification ratio of each test toner pattern in the main scanning direction, and skew of each test toner pattern relative to the main scanning direction are detected.

It is to be noted that the main scanning direction in the present illustrative embodiment refers to a direction in which laser light changes its phase on the photoconductor when reflected by a polygon mirror. The controller 140 calculates the detection time differences (tky, tkm and tkc) between the test toner pattern of black (K) and each of the test toner patterns of yellow, magenta, and cyan in the chevron patches based on the detection signals provided by the optical detectors 151Y, 151M, 151C and 151K.

In FIG. 4, the main scanning direction coincides with the vertical direction. In the chevron patch, a set of test toner patterns of yellow, magenta, cyan, and black aligned in this order from the left and another set of test toner patterns of black, cyan, magenta, and yellow aligned in this order from the left, slanted 90° from the former set of test toner patterns, are arranged side by side. The controller 140 obtains the deviation amount in the sub-scanning direction, that is, the amount of registration deviation, with respect to each of the test toner patterns based on the differences between the actual and theoretical values of the detection time differences tky, tkm, and tkc.

The controller 140 adjusts the timing for optically writing an image on the photoconductor 1 with respect to every other face i.e., per scan line pitch, of the polygon mirror of the optical writing unit 20 in the controlled section 145, based on the amount of registration deviation, so that registration deviation for each color is reduced.

In FIG. 4, characters tk, tc, tm and ty respectively represent the difference between two black images, the difference between two cyan images, the difference between two magenta images, and the difference between two yellow images.

The controller 140 obtains the skew from the main scanning direction with respect to each of the test toner patterns based on the difference in deviation amount in the sub-scanning direction between both ends of the secondary transfer belt 204. Subsequently, the controller 140 corrects the optical face tangle error of the mirrors of the optical writing unit 20 in the controlled section 145 based on the measured skew so that skew deviation is suppressed.

As mentioned above, in the color shift correction, the timings of optical writing and optical face tangle error are corrected based on the times at which the test toner patterns in the chevron patch are detected, so that registration and skew deviations are suppressed. Even when the positions on the recording medium P at which toner images are formed change with time due to changes in the temperature, color shift is suppressed by the above-described color shift correction.

Next, a description is provided of processing in the refresh mode associated with the developing devices 5.

When images with a relatively low image area are continuously produced, the amount of aged toner, which stays in the developing device 5 for a long period of time, increases, and therefore the charge property of the toner in the developing device deteriorates, thereby producing images having poor image quality due to deterioration of developing ability and transferability of the toner. In view of the above, the controller 140 can carry out the refresh mode in which spent toner is forcibly discharged from the developing devices to a non-image area on the photoconductors 1Y, 1M, 1C, and 1K at predetermined timing. Fresh toner is supplied to the developing devices in which the toner density has dropped after discharging forcibly the toner.

The controller 140 stores the amount of toner consumption in each of the developing devices 5Y, 5M, 5C, and 5K, and operating time of each of the developing devices 5Y, 5M, 5C, and 5K. At a predetermined timing, the controller 140 checks whether or not the amount of toner consumed in each of the developing devices 5Y, 5M, 5C, and 5K during the operating time of the developing devices in a certain time period is equal to or less than a threshold value, and then carries out the refresh mode only in the developing devices in which the amount of toner consumption is equal to or less than the threshold value.

In the refresh mode, a toner consumption pattern as a test toner pattern is formed on the non-image area on the photoconductor between successive images or between the previous and the subsequent recording media sheets. When forming the toner consumption patterns, the developing devices consume toner. The toner consumption patterns on the photoconductors 1 are transferred primarily onto the intermediate transfer belt 8 and then secondarily transferred onto the secondary transfer belt 204. The weight of toner in the toner consumption pattern is determined based on the amount of toner consumed during the operating time of the developing devices in a certain time period. The maximum weight of toner per unit area may be about 1.0 mg/cm$^2$.

During regular image formation, toner hardly sticks to the secondary transfer belt 204. Thus, after consecutive prints, no toner is present between the secondary transfer belt 204 and the cleaning blade 209. As a result, lubricating effects are not achieved between the secondary transfer belt 204 and the cleaning blade 209, hence increasing frictional force. With an increase in the frictional force, the cleaning blade 209 contacting the secondary transfer belt 204 gets curled, causing cleaning failure and contamination of the back of the recording medium.

According to the present illustrative embodiment, as described above, the gradation patterns and the test toner patterns for correction of color shift are removed by the cleaning blade 209. In order to remove these toner patters thoroughly, the cleaning blade 209 needs to contact the secondary transfer belt 204 at a certain contact pressure. Therefore, the cleaning blade 209 gets easily curled. However, it is possible to maintain the lubricating effect by toner and prevent curling of the cleaning blade 209 if the toner consumption pattern is formed between successive recording media sheets and is transferred onto the secondary transfer belt 204.

Figure 5:
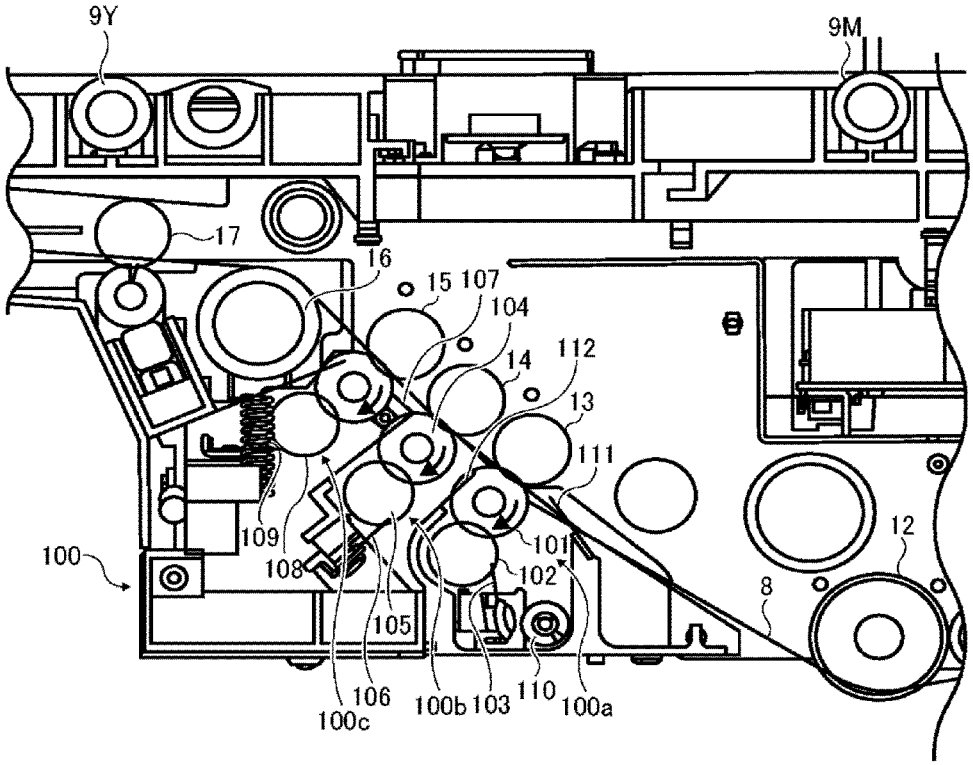
FIG. 5 is a schematic diagram illustrating a belt cleaning device according to illustrative embodiments of the present disclosure.

FIG. 5 is a schematic diagram illustrating a belt cleaning device 100 according to illustrative embodiments of the present disclosure.

The belt cleaning device 100 includes a first cleaning station 100*a*, a second cleaning station 100*b*, and a third cleaning station 100*c*.

The first cleaning station 100*a* is disposed at the extreme upstream end in the traveling direction of the intermediate transfer belt 8. The first cleaning station 100*a* electrostatically removes, from the intermediate transfer belt 8, the reversely-charged toner (i.e., when the normally-charged toner has a negative polarity, the reversely-charged toner has a positive polarity). That is, the toner with positive charge is electrostatically removed.

The second cleaning station 100*b* and the third cleaning station 100*c* disposed downstream from the first cleaning station 100*a* in the traveling direction of the intermediate transfer belt 8 electrostatically remove, from the intermediate transfer belt 8, the normally-charged toner, i.e., toner having a negative polarity.

Each of the first cleaning station 100*a*, the second cleaning station 100*b*, and the third cleaning station 100*c* includes the first cleaning brush roller 101, the second cleaning brush roller 104, and the third cleaning brush roller 107, and a first toner collecting roller 102, a second toner collecting roller 105, and a third toner collecting roller 108, respectively. Each of the first cleaning station 100*a*, the second cleaning station 100*b*, and the third cleaning station 100*c* includes a first scraping blade 103, a second scraping blade 106, and a third scraping blade 109, respectively, to contact the first through third toner collecting rollers 102, 105, and 108, respectively, and remove toner from the roller surface.

The first cleaning brush roller 101 of the first cleaning station 100*a* is supplied with a voltage having a negative polarity. The second cleaning brush roller 104 of the second cleaning station 100*b* and the third cleaning brush roller 107 of the third cleaning station 100*c* are supplied with a voltage having a positive polarity.

Each of the first through third cleaning brush rollers 101, 104, and 107 is comprised of a metal rotary shaft rotatably supported and a brush portion constituted of multiple raised fibers (bristles) disposed on the outer periphery of the metal rotary shaft. The outer diameter of the first through third cleaning brush rollers 101, 104 and 107 is in a range of from 15 mm to 16 mm.

The bristles have a double-layer (core-clad) structure such that conductive material such as conductive carbon is used for the inner portion of the fibers, and insulating material such as polyester is used for the surface portion thereof. In this configuration, the potential of the core portion of the bristles can have substantially the same potential of the voltage applied to the cleaning brush rollers. Accordingly, the toner can be electrostatically attracted to the surface of the bristles of the cleaning brush rollers. Thus, the toner on the intermediate transfer belt 8 is electrostatically adhered to the bristles of the first through third cleaning brush rollers 101, 104 and 107 due to the voltage supplied to the cleaning brush rollers.

The structure of the bristles of the first through third cleaning brush rollers 101, 104, and 107 is not limited to the double-layer structure, and in some embodiments the bristles are constituted only of conductive fibers. In addition, in some embodiments the bristles are disposed obliquely on the rotary shaft relative to the normal line of the rotary shaft (i.e., the cleaning brush rollers may have oblique bristles).

Alternatively, it is possible that the core-clad bristles are used for the cleaning brush roller 104 and the cleaning brush roller 107, and the bristles of the cleaning brush roller 101 are made only of conductive fibers. When bristles made of only conductive fibers are used for the first cleaning brush roller 101, charges can be injected easily from the first cleaning brush roller 101 into the toner, thereby making it possible to control the polarity of the toner on the intermediate transfer belt 8 to have the negative polarity. When the core-clad bristles are used for the second cleaning brush roller 104 and the third cleaning brush roller 107, injection of charges into the toner can be prevented, thereby preventing the toner on the intermediate transfer belt 8 from getting charged to a positive polarity. With this configuration, the second cleaning brush roller 104 and the third brush roller 107 prevent the toner on the intermediate transfer belt 8 from getting reversely charged, so that the toner which cannot be electrostatically removed is reduced.

The tips of the bristles of the first cleaning brush roller 101, the second cleaning brush roller 104 and the third cleaning brush roller 107 bite into the intermediate transfer belt 8 in an amount approximately 1 mm. The first through third cleaning brush rollers 101, 104 and 107 are rotated by a driving device such that the bristles move in a direction (a counter direction) opposite to the traveling direction of the intermediate transfer belt 8 at the contact position, thereby increasing the velocity difference between the bristles of the cleaning brush rollers and the intermediate transfer belt 8. Therefore, chances in which a portion of the intermediate transfer belt 8 comes into contact with the bristles of the cleaning brush rollers before the intermediate transfer belt 8 passes the cleaning brush rollers can be increased so that the toner can be removed from the intermediate transfer belt 8 reliably and satisfactory.

The intermediate transfer belt 8 is interposed between the first through third cleaning brush rollers 101, 104, and 107 and the cleaning opposed rollers 13, 14, and 15.

Because the positional relations of the first through third cleaning brush rollers 101, 104, and 107, and the cleaning opposed rollers 13, 14, and 15 are the same between the first cleaning station 100*a*, the second cleaning station 100*b*, and the third cleaning station 100*c*, the description is provided of the positional relation of the first cleaning brush roller 101 and the cleaning opposed roller 13 as a representative example.

Figure 6:
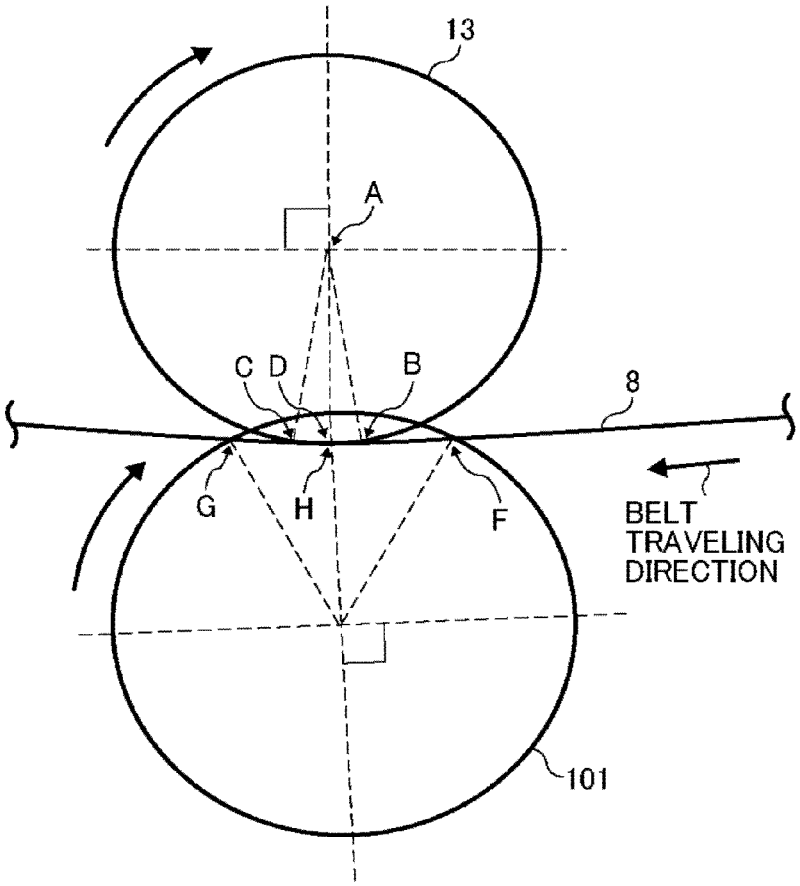
FIG. 6 is a schematic diagram illustrating a first cleaning brush roller and a cleaning opposed roller.

FIG. 6 is a schematic diagram illustrating the first cleaning brush roller 101 and the cleaning opposed roller 13.

The traveling direction of the intermediate transfer belt 8 is from the right to the left in FIG. 6. The cleaning opposed roller 13 is a roller made of aluminum having a diameter ϕ of approximately 14 mm and is a follower roller which is rotated by a frictional force generated by contacting the intermediate transfer belt 8. The cleaning opposed roller 13 is connected to ground. The intermediate transfer belt 8 is entrained about an arc portion of the cleaning opposed roller 13 from a point B to a point C shown in FIG. 6. The arc portion between the point B and the point C is hereinafter referred to as a belt nip portion. In FIG. 6, a point A refers to a center of the cleaning opposed roller 13 in cross-section. A center point D refers to a center of the nip portion in the traveling direction of the intermediate transfer belt 8.

The first cleaning brush roller 101 contacts the front surface of the intermediate transfer belt 8 between a point F to a point G. The point F refers to a nip entry point and the point G refers to a nip exit point, and the area between the point F and the point G is hereinafter referred to as a brush nip portion. A center point H in FIG. 6 refers to a center of the brush nip portion in the traveling direction of the intermediate transfer belt 8. As illustrated in FIG. 6, in the belt cleaning device 100, the center point D of the belt nip portion in the traveling direction of the intermediate transfer belt 8 coincides with the center point H of the brush nip portion in the traveling direction of the intermediate transfer belt 8. The brush nip portion is substantially longer than the belt nip portion.

Exemplary configurations of the first cleaning brush roller 101, the second cleaning brush roller 104, and the third cleaning brush roller 107 are described below.

Brush material: Conductive polyester having a core-clad structure with conductive carbon enclosed inside fibers and the surface of the fibers made of polyester Brush resistance: $10^6\Omega$~$10^8\Omega$ Applied voltage (V) of the rotary shaft First cleaning brush roller 101: −2000 V~−2400 V Second cleaning brush roller 104: +1600 V~+2000 V Third cleaning brush roller 107: +800 V~+1200 V Bristle density: 70,000 to 100,000 fibers/inch$^2$ Brush fiber diameter: Approximately 25 to 35 μm Falling treatment of tip of bristles: Yes Brush diameter ϕ: 15 mm to 16 mm Brush fiber penetration in the intermediate transfer belt 8: Approximately 1 mm The bristle density, the brush resistance, the brush fiber diameter, the applied voltage, the type of fiber, the brush penetration amount can be optimized depending on the system for which the cleaning brush rollers are used, and thus are not limited to this. The type of fibers includes, but is not limited to nylon, acrylic, and polyester.

Each of the first through third toner collecting rollers 102, 105, and 108 electrostatically collects toner adhered to the respective cleaning brush rollers such that the toner is dislocated from the brush to the toner collecting rollers by a potential gradient of the raised fibers (bristles) and the toner collecting rollers. In the present embodiment, a stainless steel (SUS) roller is used for the first through third toner collecting rollers 102, 105, and 108.

However, the material of the toner collecting rollers is not limited thereto, and any materials can be used as long as the first through third toner collecting rollers 102, 105 and 108 can have a function of transferring the toner adhered to the cleaning brush rollers to the toner collecting rollers utilizing the potential difference between the bristles of the cleaning brush rollers and the toner collecting rollers. For example, each of the first through third toner collecting rollers 102, 105, and 108 may be formed of a conductive metal cored bar covered with an elastic tube having a relatively high resistance from a few micrometers (μm) to 100 micrometers (μm), or coated with insulating material, to obtain a roller resistance log R of 12Ω to 13Ω

Using a SUS roller for the first through third toner collecting rollers 102, 105 and 108 is advantageous in that costs of the rollers can be reduced, and in addition the voltage to be applied to the rollers can be reduced, resulting in electric power saving. By contrast, the first through third toner collecting rollers 102, 105, and 108 covered with the high-resistance elastic tube or insulating material hence achieving a roller resistance log R of 12Ω to 13Ω are advantageous in that when collecting the toner with the toner collecting rollers, injection of charges into the toner can be prevented, thereby preventing the toner from having the same polarity as that of the voltage applied to the toner collecting rollers, and hence resulting in prevention of reduction of the toner collection rate.

Voltages applied to the toner collecting rollers 102, 105, and 108 are such voltages that cause the removed toner having a positive polarity for the first cleaning brush roller 101 and a negative polarity for the second and the third cleaning brush rollers 104 and 107 to adhere to the first through third toner collecting rollers 102, 105, and 108. The potential difference relative to the cleaning brush rollers is approximately 100V to 500V, preferably, 350V to 450V, thereby enabling the toner on the cleaning brush rollers to stick to the toner collecting rollers.

Exemplary configurations of the first through third toner collecting rollers 102, 105, and 108 are described below.

Cored material: SUS

Brush fiber penetration to the toner collecting rollers: 1.5 mm

Applied voltage to the cored metal of the toner collecting rollers

First toner collecting roller 102: −2400 V to −2800 V

Second toner collecting roller 105: +2000 V to +2400 V

Third toner collecting roller 108: +1000 V to +1400 V

The material, the applied voltage, the brush penetration amount can be optimized depending on the system for which the toner collecting rollers are used, and thus are not limited to this.

The first through third scraping blades 103, 106, and 109 scrape the toner adhered to the first through third toner collecting rollers 102, 105, and 108, respectively. Exemplary configurations of the first through third scraping blades 103, 106, and 109 are described below.

Blade contact angle: Approximately 20°

Blade thickness: Approximately 0.1 mm

Blade penetration to toner collecting rollers: Approximately 1.0 mm

The blade contact angle, thickness, and penetration amount can be optimized depending on the system for which the blades are used, and thus are not limited to the conditions described above.

A description is now provided of cleaning operation of the belt cleaning device 100.

Referring back to FIG. 5, after passing the secondary transfer portion or the secondary transfer nip, the residual toner remaining on the intermediate transfer belt 8 even after the transferring process as well as the non-transferred toner images present on the intermediate transfer belt 8 are transported by rotation of the intermediate transfer belt 8 so as to pass through an entrance seal 111, and then delivered to the position at which the residual toner and the non-transferred toner images come to the first cleaning brush roller 101.

The first cleaning brush roller 101 is supplied with a voltage having the same polarity (i.e., negative polarity) as that of the normally-charged toner. An electrical field is formed by the potential difference between the surface potential of the intermediate transfer belt 8 and the surface potential of the first cleaning brush roller 101. With this electrical field, the reversely-charged toner charged with a polarity (positive polarity) opposite that of the normally-charged toner during the secondary transfer on the intermediate transfer belt 8 is electrostatically attracted to the first cleaning brush roller 101. That is, the toner charged with a positive polarity is attracted to the first cleaning brush roller 101.

Furthermore, due to injection of charges and electrical discharge, a part of toner particles receives negative charges from the first cleaning brush roller 101 and hence is charged with a normal polarity, thus staying on the intermediate transfer belt 8.

The reversely-charged (positive polarity) toner absorbed to the first cleaning brush roller 101 is transported to the contact position with the first toner collecting roller 102. The first toner collecting roller 102 is supplied with a negative voltage greater than the voltage supplied to the first cleaning brush roller 101. Thus, the toner on the first cleaning brush roller 101 is electrostatically attracted to the first toner collecting roller 102 due to the electrical field formed by the potential difference between the surface potential of the first cleaning brush roller 101 and the surface potential of the first toner collecting roller 102. The toner having a positive polarity attracted to the first toner collecting roller 102 is scraped off from the surface of the first toner collecting roller 102 by the first scraping blade 103.

The toner scraped off by the first scraping blade 103 is then discharged from the image forming apparatus by a discharge screw 110.

Toner not having been removed by the first cleaning brush roller 101, thus remaining on the intermediate transfer belt 8, is delivered to the second cleaning brush roller 104. The second cleaning brush roller 104 is supplied with a voltage having the opposite polarity (i.e., positive polarity) as that of the normally-charged toner. An electrical field is formed by the potential difference between the surface potential of the intermediate transfer belt 8 and the surface potential of the second cleaning brush roller 104. With this electrical field, the normally-charged toner charged with a negative polarity on the intermediate transfer belt 8 is electrostatically absorbed to the second cleaning brush roller 104. That is, the toner charged with a negative polarity is absorbed.

The normally-charged toner absorbed to the second cleaning brush roller 104 is delivered to the contact position with the second toner collecting roller 105. The second toner collecting roller 105 is supplied with a positive voltage greater than the voltage supplied to the second cleaning brush roller 104. Thus, the toner on the second cleaning brush roller 104 is electrostatically attracted to the second toner collecting roller 105 due to the electrical field formed by the potential difference between the surface potential of the second cleaning brush roller 104 and the surface potential of the second toner collecting roller 105. The normally-charged toner attracted to the second toner collecting roller 105 is scraped off from the surface of the second toner collecting roller 105 by the second scraping blade 106.

Toner, the polarity of which has shifted to a negative polarity by the first cleaning brush roller 101 and the normally-charged toner with a negative polarity not having been removed by the second cleaning brush roller 104, thus remaining on the intermediate transfer belt 8, are delivered to the third cleaning brush roller 107.

The polarity of toner delivered to the third cleaning brush roller 107 is controlled to have a negative polarity by the second cleaning brush roller 104. Since substantially all the toner particles on the intermediate transfer belt 8 are removed therefrom by the first cleaning brush roller 101 and the second cleaning brush roller 104 and 104, the amount of toner particles delivered to the third cleaning brush roller 107 is very small.

The small amount of toner on the intermediate transfer belt 8 delivered to the third cleaning brush roller 107 has a negative polarity and is electrostatically attracted to the third cleaning brush roller 107 supplied with a voltage having a positive polarity which is opposite that of the normally-charged toner. Subsequently, the toner is electrostatically collected by the third toner collecting roller 108 supplied with a voltage having a positive polarity greater than that of the third cleaning brush roller 107. The toner attracted to the third toner collecting roller 108 is scraped off from the surface of the third toner collecting roller 108 by the third scraping blade 109.

According to the present illustrative embodiment, the distance between the brush nip portion of the second cleaning brush roller 104 and the brush nip portion of the third cleaning brush roller 107 is approximately 44 mm, which is relatively short. By making the distance between the cleaning brush rollers short, cleaning ability of the second and the third cleaning brush rollers can be enhanced.

In a known belt cleaning device, the second cleaning station 100*b* removes electrostatically the reversely-charged toner on the intermediate transfer belt 8, and the first and the third cleaning stations 100*a* and 100*c* remove the normally-charged toner. In this configuration, test toner patterns such as the gradation patterns, chevron patches, and toner consumption patterns on the intermediate transfer belt 8 can be removed at once. However, depending on the toner, the test toner patterns are not removed successfully, hence degrading cleanability.

In view of the above, according to the present illustrative embodiment, the test toner patterns such as the gradation patterns, chevron patches, and toner consumption patterns are transferred onto the secondary transfer belt 204 and removed by the secondary transfer cleaning device 230. As compared with the intermediate transfer belt 8, the secondary transfer belt 204 does not have an elastic layer. Thus, even when the cleaning blade is used, a desired contact pressure can be achieved, hence reliably scraping off the toner by the cleaning blade. With this configuration, the test toner patterns are transferred to the secondary transfer belt 204 and reliably removed therefrom by the secondary transfer cleaning device 230. Furthermore, the test toner patterns do not enter the belt cleaning device 100 so that only the secondary-transfer residual toner enters the belt cleaning device 100.

However, the known belt cleaning device fails to electrostatically remove toner, the polarity of which has changed, even when there is only the secondary-transfer residual toner in the belt cleaning device, resulting in a decrease in the cleanability.

In view of the above, according to the illustrative embodiments of the present disclosure, after the first cleaning station 100*a* removes the reversely-charged toner from the intermediate transfer belt 8, the second cleaning station 100*b* and the third cleaning station 100*c* remove the normally-charged toner. With this configuration, the toner, which is difficult to electrostatically remove after the polarity thereof is changed, can be removed reliably. Desired cleanability is achieved.

According to the illustrative embodiments of the present disclosure, the difference in the linear velocity between the secondary transfer belt 204 and the intermediate transfer belt 8 when transferring the test toner pattern to the secondary transfer belt 204 is greater than when an image is formed on the recording medium. According to the illustrative embodiments of the present disclosure, when forming an image on the recording medium, the linear velocity of the secondary transfer belt 204 is substantially the same as the linear velocity of the intermediate transfer belt 8 (Difference in the linear velocity=0). When transferring the gradation patterns, the color-shift correction patterns, and the toner consumption patterns onto the secondary transfer belt 204, the linear velocity of the secondary transfer belt 204 is slightly increased relative to the linear velocity of the intermediate transfer belt 8.

When a pulse motor is employed for the drive motor for the secondary transfer roller 18, the linear velocity of the secondary transfer belt 204 can be changed by adjusting the pulse number per input time. When a DC motor is employed, the linear velocity of the secondary transfer belt 204 can be changed by adjusting an input voltage or the like. In this case, the accuracy of the linear velocity of the secondary transfer belt 204 is maintained by detecting and feedback-controlling one of the number of revolutions of the separation roller 205 as a driven roller, the optical-detector opposed roller 206, and the cleaning opposed roller 207.

The linear velocity of the secondary transfer belt 204 is changed as follows. The time at which the test toner pattern passes the secondary transfer nip is obtained from the linear velocity of each of the photoconductors and the intermediate transfer belt 8 from the writing start time for writing an image on the photoconductors as a trigger. The controller 140 starts to measure the time when image writing on each of the photoconductors is started.

After a predetermined time period elapses, the linear velocity of the secondary transfer nip is changed. While the test toner pattern passes the secondary transfer nip, the changed linear velocity of the secondary transfer nip is maintained. After the test toner pattern passes the secondary transfer nip, the linear velocity is changed back to the linear velocity employed at the time of image formation.

In some embodiments, the predetermined time period from the start of image writing on each of the photoconductors to the time of changing the linear velocity can be adjusted based on a time period from the start of image writing to an actual time at which the optical detector 151 detects the test toner pattern. More specifically, the time period from the start of image writing until the optical detector 151 detects the test toner pattern is detected. In a case in which the detected time period deviates from a preset value by an amount equal to or greater than a predetermined value, the time at which the test toner pattern passes the secondary transfer nip from the start of image writing is adjusted.

In the correction, a time for the test toner pattern to arrive at the secondary transfer nip from the start of actual image writing is obtained such that a time for the test toner pattern to arrive at the optical detector 151 from the secondary transfer nip is obtained based on the preset speed of the secondary transfer belt, and the distance between the secondary transfer nip and the optical detector 151. Then, the time thus obtained is subtracted from the detected time. Based on the result, the predetermined time period until the linear velocity of the secondary transfer belt is changed is adjusted.

When the linear velocity of the secondary transfer belt 204 is different from the linear velocity of the intermediate transfer belt 8, in addition to the electrostatic force, a mechanical stripping force, which strips the toner from the intermediate transfer belt 8, is added, thereby increasing transferability. Therefore, when the secondary transfer belt 204 and the intermediate transfer belt 8 have different linear velocities upon forming the test toner pattern, the amount of residual toner after secondary transfer can be reduced, hence reducing the amount of toner entering the belt cleaning device 100.

More specifically, when the toner consumption pattern has the maximum weight of toner per unit area of approximately 1.0 mg/cm$^2$, preferably, the secondary transfer belt 204 and the intermediate transfer belt 8 have different linear velocities.

However, the different linear velocities between the secondary transfer belt 204 and the intermediate transfer belt 8 may cause the secondary transfer belt 204 and the intermediate transfer belt 8 to slidably contact each other, hence damaging the intermediate transfer belt 8 and the secondary transfer belt 204 and degrading their product life cycles. Thus, during the normal image forming operation, substantially the same linear velocity is employed for the secondary transfer belt 204 and the intermediate transfer belt 8. Only when forming the test toner pattern, which is less frequently formed, the intermediate transfer belt 8 and the secondary transfer belt 204 have different linear velocities, thereby reducing the rate at which the product life is shortened.

When forming the gradation patters, the difference in the linear velocities is relatively small, and the same difference as that in the normal image forming operation may be employed. With this configuration, the effect of the secondary transfer is detected accurately.

According to the illustrative embodiments of the present disclosure, the voltage supplied to each of the cleaning brush rollers 101, 104, and 107 is determined based on a measured cleaning current that flows between the cleaning brush rollers 101, 104, and 107 and the cleaning opposed rollers.

However, if the voltage supplied to each of the cleaning brush rollers 101, 104, and 107 is subjected to constant current control so that the cleaning current achieves a predetermined current, the current flows through a low-resistance portion of the cleaning brush rollers in the axial direction thereof when the resistance of the cleaning brush rollers varies in the axial direction due to a difference in the amount of toner in the cleaning toner layer and the brushes.

Therefore, even with a low voltage, the cleaning current that flows between the cleaning brush rollers and the opposed rollers has the predetermined value. As a result, the cleaning current becomes the predetermined value or less at the place with a thick toner layer at which good cleaning performance is most required. As a result, desired cleanability is not achieved.

By contrast, under constant voltage control, the voltage does not get too low, thereby preventing the cleaning current from becoming the predetermined value or less at the place at which good cleaning performance is most required. However, when the voltage supplied to each of the cleaning brush rollers 101, 104, and 107 is subjected to constant voltage control, due to changes in the environment conditions and in the resistance of the entire brush, the cleaning current drops, which prevents the cleaning brush rollers from electrostatically attracting the toner on the intermediate transfer belt.

Furthermore, the cleaning current becomes excessive, resulting in excessive injection of charges to the toner on the intermediate transfer belt and hence reversing the polarity of toner. As a result, the toner is no longer electrostatically attracted to the cleaning brush rollers. In both cases, the cleaning failure occurs.

According to the illustrative embodiments of the present disclosure, the voltage supplied to each of the cleaning brush rollers 101, 104, and 107 is adjusted periodically or when an environment detector detects a certain amount of change in environment conditions such as temperature and humidity. More specifically, prior to application of power or adjustment of the image density, the following operation is performed.

First, the controller 140 activates the driving devices associated with the belt cleaning such as the intermediate transfer belt 8, the secondary transfer belt 204, the cleaning brush rollers, and so forth. Subsequently, the secondary transfer bias is turned on, and then the same voltage as the voltage which has been used during the previous operation is applied to the first through third cleaning brush rollers 101, 104, and 107, and each of the toner collecting rollers 102, 105, and 108.

Next, whether or not the cleaning current flowing between the first cleaning brush roller 101 and the cleaning opposed roller 13 is within an optimum range is determined. If the cleaning current is out of the optimum range, the voltage to be supplied to the first cleaning brush roller 101 is adjusted so that the cleaning current falls within the optimum range. Based on the voltage to be supplied to the first cleaning brush roller 101, the voltage to be supplied to the first toner collecting roller 102 is adjusted so that the potential difference between the first cleaning brush roller 101 and the first toner collecting roller 102 is at the predetermined level.

Next, whether or not the cleaning current flowing between the second cleaning brush roller 104 and the cleaning opposed roller 14 is within an optimum range is determined. Similar to the above-described manner, the voltage to be supplied to the second cleaning brush roller 104 and the voltage to be supplied to the second toner collecting roller 105 are adjusted so that the cleaning current falls in the optimum range.

Next, similarly, whether or not the cleaning current flowing between the third cleaning brush roller 107 and the cleaning opposed roller 15 of the third cleaning station 100*c* is within an optimum range is determined. The voltage to be supplied to the third cleaning brush roller 107 and the voltage to be supplied to the third toner collecting roller 108 are adjusted so that the cleaning current falls within the optimum range.

The optimum range of the cleaning current in the adjustment of the voltage of the cleaning brush rollers is obtained as follows.

Figure 7:
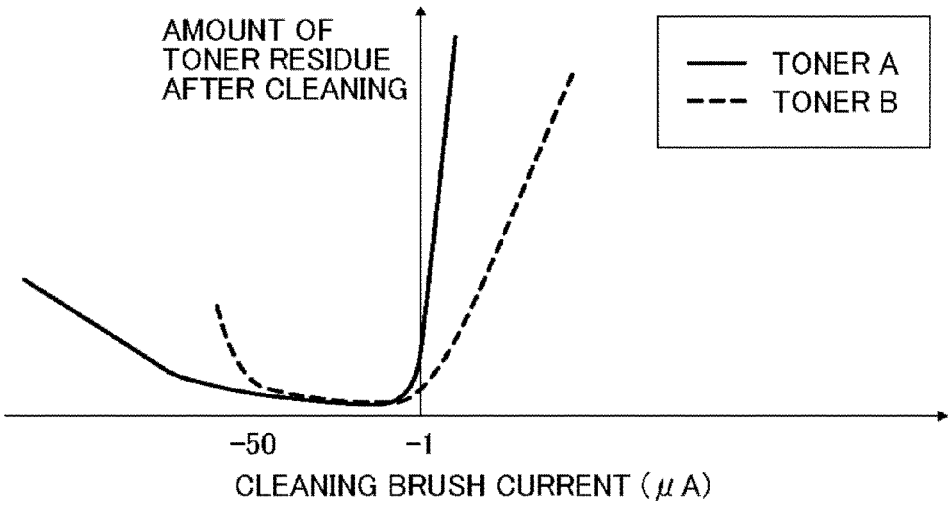
FIG. 7 is a graph showing a relation of a cleaning current and an amount of residual toner after passing the first cleaning brush roller.

FIG. 7 is a graph showing a relation of a cleaning current and an amount of residual toner after passing the first cleaning brush roller 101.

In an experiment, the secondary-transfer residual toner after a toner image of each color having a maximum amount of toner used in the image forming apparatus was transferred onto the secondary transfer belt was provided to the first cleaning brush roller. The amount of the cleaning residual toner was measured by transferring the toner remaining on the intermediate transfer belt onto a tape after passing the first cleaning brush roller. The experiment was performed in a high-temperature, high-humidity environment in which the electrostatic brush cleaning is most difficult, that is, the brush is difficult to attract the toner electrostatically. Such an experiment was performed using two different types of toners with different cleaning currents.

As illustrated in FIG. 7, the result shows that regardless of the types of the toner, good cleanability was achieved with the cleaning current in a range from −1 μA to −50 μA. This means that in the first cleaning station 100*a* the voltage to be supplied to the first cleaning brush roller 101 is set so as to achieve the cleaning current in a range from −1 μA to −50 μA. With this configuration, good cleanability is achieved. According to the illustrative embodiments, considering various changes, the optimum range of the cleaning current is set in a range from −20 μA to −50 μA, and the voltage to be supplied to the first cleaning brush roller 101 is set so as to achieve the cleaning current of −20 μA to −50 μA.

Figure 8:
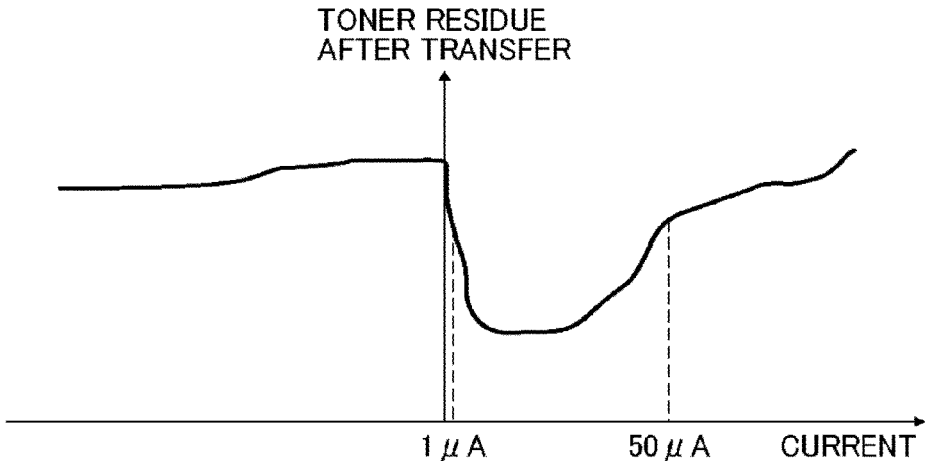
FIG. 8 is a graph showing a relation of the cleaning current and the amount of residual toner after passing a second cleaning brush roller.

FIG. 8 is a graph showing a relation of the cleaning current and the amount of residual toner after passing the second cleaning brush roller 104.

The experiment was performed in a high-temperature, high-humidity environment. The secondary-transfer residual toner after a toner image of each color having a maximum amount of toner used in the image forming apparatus was transferred onto the secondary transfer belt was provided to the first cleaning brush roller. The toner that passed the first cleaning brush roller was provided to the second cleaning brush roller. At this time, the first cleaning brush roller 101 was supplied with a voltage that allows the cleaning current to be in a range from −20 μA to −50 μA. The amount of the cleaning residual toner was measured by transferring the toner remaining on the intermediate transfer belt onto a tape after passing the second cleaning brush roller 104.

As illustrated in FIG. 8, in the second cleaning station 100*b*, good cleanability was achieved with the cleaning current in a range from +1 μA to +50 μA. This means that in the second cleaning station 100*b* the voltage to be supplied to the first cleaning brush roller 101 is set so as to achieve the cleaning current in a range from −1 μA to −50 μA. With this configuration, good cleanability is achieved.

According to the illustrative embodiments, considering various changes, the optimum range of the cleaning current of the second cleaning station 100*b* is set in a range from +10 μA to +40 μA, and the voltage to be supplied to the second cleaning brush roller 104 is set to achieve the cleaning current in a range from +10 μA to +40 μA.

Figure 9:
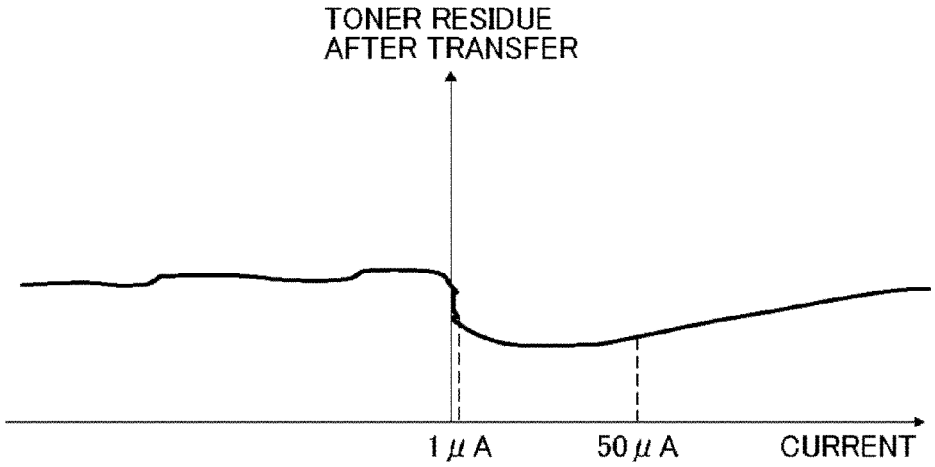
FIG. 9 is a graph showing a relation of the cleaning current and the amount of residual toner after passing a third cleaning brush roller.

FIG. 9 is a graph showing a relation of a cleaning current and an amount of residual toner after passing the third cleaning brush roller 107.

Similar to the experiment described above, the experiment was performed in a high-temperature, high-humidity environment. The secondary-transfer residual toner after a toner image of each color having a maximum amount of toner used in the image forming apparatus was transferred onto the secondary transfer belt was provided to the first cleaning brush roller. The toner that passed the first cleaning brush roller 101 and the second cleaning brush roller 104 was provided to the third cleaning brush roller 107. At this time, the first cleaning brush roller 101 was supplied with a voltage that allows the cleaning current to be in a range from −20 μA to −50 μA. The second cleaning brush roller 104 was supplied with a voltage that allows the cleaning current to be in a range from +10 μA to +40 μA. The amount of the cleaning residual toner was measured by transferring the toner remaining on the intermediate transfer belt onto a tape after passing the third cleaning brush roller 107.

As illustrated in FIG. 9, in the third cleaning station 100*c*, good cleanability was achieved with the cleaning current in a range from +1 μA to +50 μA. This means that in the third cleaning station 100*c* the voltage to be supplied to the third cleaning brush roller 107 is set to so as to achieve the cleaning current in a range from +1 μA to +50 μA. With this configuration, good cleanability is achieved.

According to the illustrative embodiments, considering various changes, the optimum range of the cleaning current in the third cleaning station 100*c* is set in a range from +10 μA to +40 μA, and the voltage to be supplied to the third cleaning brush roller 107 is set to achieve the cleaning current in a range from +10 μA to +40 μA.

It is to be noted that the amount of toner entering the third cleaning station 100*c* is very small as compared with the second cleaning station 100*b*. Therefore, a degree of tolerance considering various changes can be set to be small and the optimum range of the current can be increased as compared with the second cleaning station 100*b*.

The upper threshold of the optimum range of the cleaning current of the second cleaning station 100*b* and the third cleaning station 100*c* is +40 μA, not +50 μA, in order to prevent leakage current (which is disadvantageous when it is high.) In the second cleaning station 100*b* and in the third cleaning station 100*c*, good cleanability was achieved with the cleaning current in a range from +1 μA to +50 μA for the following reason. That is, the second cleaning brush roller 104 and the third cleaning brush roller 107 employ the same type (material, density, resistance, and so forth) of a brush, and the leakage current was substantially the same because the conditions around these cleaning brush rollers are not so different.

According to the illustrative embodiments, each of the toner collecting rollers 102, 105, and 108, and each of the cleaning brush rollers 101, 104, and 107 are supplied with voltage. Alternatively, in some embodiments, the toner collecting rollers 102, 105, and 108 are comprised of metal rollers, and the voltage is supplied only to the toner collecting rollers 102, 105, and 108. In this case, a bias voltage somewhat lower than the bias voltage supplied to the toner collecting rollers is supplied to the cleaning brush rollers via a contact portion with the toner collecting rollers due to a decrease in the potential caused by the resistance of fibers of the cleaning brush rollers. Accordingly, the potential difference is formed between the toner collecting roller and the cleaning brush roller, and the potential gradient causes the toner to move from the cleaning brush rollers to the toner collecting rollers.

The present disclosure is applied to the belt cleaning device that cleans the intermediate transfer belt. The present disclosure can be applied to the drum cleaning device 4 that cleans the photoconductors.

Toner suitable for the image forming apparatus according to the illustrative embodiments of the present disclosure is described in detail below.

The toner has a volume average particle diameter (Dv) preferably in a range from 3 μm to 6 μm to reproduce fine-dot toner images with a size of 600 dpi (dot per inch) or smaller. A ratio (Dv/Dn) of the volume average particle diameter (Dv) to the number average particle diameter (Dn) of the toner is preferably in a range from 1.00 to 1.40. As the ratio (Dv/Dn) approaches 1.00, the toner has a narrower particle diameter distribution. Such a toner having a small particle diameter and a narrow particle diameter distribution has a uniform charge quantity distribution, which can produce high-quality images without background fouling. In particular, such a toner exhibits a high transfer rate in an electrostatic transfer method.

Figure 10:
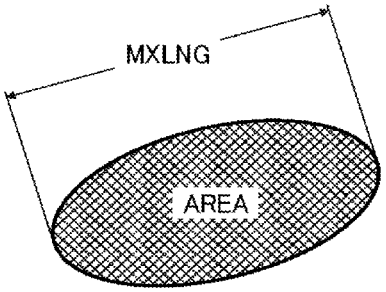
FIG. 10 is a schematic diagram illustrating a toner particle for describing the maximum diameter and the area of the projected image of the toner particle.

The toner preferably has a first shape factor SF-1 of from 100 to 180, and a second shape factor SF-2 of from 100 to 180. FIG. 10 is a schematic diagram illustrating a shape of toner for explaining the first shape factor SF-1. The first shape factor SF-1 represents a degree of roundness of a toner particle and is expressed by formula 1:

$SF\text{-}1=\{(MXLNG)^2/AREA\}\times(100\pi/4)$, where MXLNG represents the maximum diameter of a projected image of a toner particle on a two-dimensional plane, and AREA represents the area of the projected image.

When the first shape factor SF-1 is 100, the toner particle has a true spherical shape. The greater is the SF-1, the more irregular the toner shape.

Figure 11:
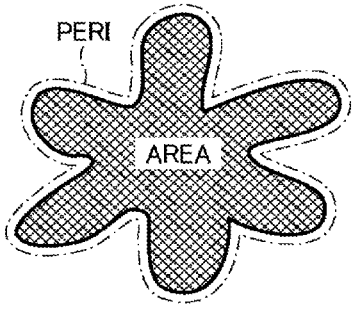
FIG. 11 is a schematic diagram for describing the peripheral length and the area of the projected image of the toner particle.

FIG. 11 is a schematic diagram illustrating a shape of toner for explaining the second shape factor SF-2. The second shape factor SF-2 represents the degree of roughness of a toner particle, and is represented by formula 2:

$SF\text{-}2=\{(PERI)^2/AREA\}\times100/(4\pi)$, where PERI represents the peripheral length of a projected image of a toner particle on a two-dimensional plane and AREA represents the area of the projected image.

When the second shape factor SF-2 is 100, the toner particle has a completely smooth surface without roughness. The greater is the second shape factor SF-2, the rougher is the toner surface.

The shape factors are determined by obtaining a photographic image of toner particles with a scanning electron microscope (S-800 manufactured by Hitachi, Ltd.) and analyzing the photographic image with an image analyzer (LUZEX 3 manufactured by Nireco Corporation). When a shape of the toner particle becomes close to a sphere, toner particles contact each other as well as the photoconductors 1 in a point contact manner. Consequently, absorption force between the toner particles weakens, resulting in high fluidity of the toner particles.

Moreover, absorption force between the toner particles and the photoconductors 1 weakens, resulting in an increase in the transfer rate. When any one of the shape factors SF-1 and SF-2 exceeds 180, the transfer rate may deteriorate, which is not preferable.

The toner preferably used in the color image forming apparatus is obtained by a cross-linking reaction and/or an elongation reaction of a toner composition liquid in an aqueous solvent. Here, the toner composition liquid is prepared by dispersing a polyester polymerize having a nitrogen-containing functional group, a polyester, a colorant, and a release agent in an organic solvent.

The toner containing the polyester resin tends to be easily charged with a positive polarity which is opposite the polarity of the normally-charged toner. Therefore, the toner containing the polyester resin tends to be partially charged easily with a positive polarity which is opposite the polarity of the normally-charged toner under a high voltage having a positive polarity.

A description is now given of toner constituents and a method for manufacturing the toner.

The polyester can be prepared by a polycondensation reaction between a polyalcohol compound and a polycarboxylic acid compound.

Specific examples of the polyalcohol compound (PO) include a diol (DIO) and a polyol having 3 or more valances (TO). The DIO alone, and a mixture of the DIO and a smaller amount of the TO are preferably used as the PO.

Specific examples of the diol (D10) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the alicyclic diols, and alkylene oxide (e.g., ethylene oxide, propylene oxide, butylene oxide) adducts of the bisphenols.

Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together.

Specific examples of the polyol (TO) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

The polycarboxylic acid (PC) may be, for example, a dicarboxylic acid (DIC), a polycarboxylic acid (TC) having three or more valences, and a mixture thereof. A dicarboxylic acid (DIC) alone or a mixture of a dicarboxylic acid (DIC) with a small amount of a polycarboxylic acid (TC) is preferable. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid).

Among the above-described examples, alkenylene dicarboxylic acids having 4 to 20 carbon atoms and aromatic dicarboxylic acids having 8 to 20 carbon atoms are preferably used.

Specific examples of the polycarboxylic acids having three or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

The equivalent ratio [OH]/[COOH] of hydroxyl groups [OH] in the polyol (PO) to carboxyl groups [COOH] in the polycarboxylic acid (PC) is typically 2/1 to 1/1, preferably 1.5/1 to 1/1, and more preferably 1.3/1 to 1.02/1. The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain polyester having hydroxyl groups. The polyester preferably has a hydroxyl value of 5 or more, and an acid value of from 1 to 30, and preferably from 5 to 20. When the polyester has the acid value within the range, the resultant toner can have a negative charging property.

Furthermore, the toner has good affinity with a recording medium, resulting in enhancement of the low-temperature fixability of the toner. However, when the acid value is too large, i.e., greater than 30, stability of the charging property of the toner deteriorates particularly when the environmental conditions change. The polyester preferably has a weight-average molecular weight of from 10,000 to 400,000, and more preferably from 20,000 to 200,000.

When the weight-average molecular weight is too small, i.e., less than 10,000, the offset resistance of the resultant toner deteriorates. When the weight average molecular weight is too large, i.e., greater than 400,000, the low-temperature fixability of the resultant toner may be poor.

The polyester may further include a urea-modified polyester in addition to an unmodified polyester obtainable from the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and then reacting amine with the polyester prepolymer (A) to crosslink and/or elongate a molecular chain thereof.

Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α,α,α', α'-tetramethyl xylylene diisocyanate), isocyanurates, materials blocked against the polyisocyanate with phenol derivatives, oxime, caprolactam or the like. These compounds can be used alone or in combination.

The equivalent ratio [NCO]/[OH] of isocyanate groups [NCO] in the polyisocyanate (PIC) to hydroxyl groups [OH] in the polyester having a hydroxyl group is in a range from 5/1 to 1/1, more preferably from 4/1 to 1.2/1, or from 2.5/1 to 1.5/1. When [NCO]/[OH] is too large, for example, greater than 5/1, the low-temperature fixability of the resultant toner deteriorates. When [NCO]/[OH] is too small, for example, less than 1/1, the urea content in ester of the modified polyester decreases and hot offset resistance of the resultant toner deteriorates. The polyester prepolymer (A) having an isocyanate group includes the polyisocyanate (PIC) units in an amount of 0.5 to 40% by weight, preferably 1 to 30% by weight, and more preferably 2 to 20% by weight.

When the content is too small, for example, less than 0.5% by weight, hot offset resistance of the resultant toner deteriorates, and in addition, the heat resistance and low-temperature fixability of the toner also deteriorate. By contrast, when the content is too large, for example, greater than 40% by weight, the lower-temperature fixability of the resultant toner deteriorates.

The average number of the isocyanate groups included in a molecule of the polyester prepolymer (A) is generally at least 1, preferably from 1.5 to 3 on average, and more preferably from 1.8 to 2.5 on average. When the number of isocyanate groups per molecule is too small, for example, less than 1, the molecular weight of the resulting urea-modified polyester decreases, which results in deterioration of the hot offset resistance of the toner.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Among these amines (B), a diamine (B1) alone and a mixture of a diamine (B1) with a small amount of a polyamine (B2) having 3 or more valences are preferable.

The equivalent ratio [NCO]/[NHx] of isocyanate groups [NCO] in the polyester prepolymer (A) to amino groups [NHx] in the amine (B) is typically 1/2 to 2/1, preferably 1.5/1 to 1/1.5, and more preferably 1.2/1 to 1/1.2. When the equivalent ratio [NCO]/[NHx] is too large or small, for example, greater than 2/1 or less than 1/2, the molecular weight of the resulting urea-modified polyester decreases, which results in deterioration of the hot offset resistance of the resultant toner.

The urea-modified polyester may include a urethane bond as well as a urea bond. The molar ratio (urea/urethane) of the urea bond to the urethane bond is typically from 100/0 to 10/90, preferably from 80/20 to 20/80, and more preferably from 60/40 to 30/70. When the content of the urea bond is too small, for example, less than 10%, the hot offset resistance of the resultant toner deteriorates.

The urea-modified polyester is prepared by a method such as a one-shot method. More specifically, first, the polyol (PO) and the polycarboxylic acid (PC) are heated to 150° C. to 280° C. in the presence of a known esterification catalyst (e.g., tetrabutoxy titanate, dibutyltin oxide), while reducing pressure and removing the produced water as necessary, to obtain a polyester having a hydroxyl group. Next, the polyester having a hydroxyl group is reacted with a polyisocyanate (PIC) at 40° C. to 140° C., to obtain a polyester prepolymer (A) having an isocyanate group. Further, the amines (B) are reacted with the polyester prepolymer (A) at from 0° C. to 140° C. to form a urea-modified polyester.

When reacting the polyisocyanate (PIC), or reacting the polyester prepolymer (A) with the amine (B), solvents can be used, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against the polyisocyanate (PIC).

The cross-linking and/or elongation reaction between the polyester prepolymer (A) and the amine (B) can be terminated with a reaction terminator, if needed, to control the molecular weight of the resulting urea-modified polyester. Specific examples of the reaction terminators include, but are not limited to, monoamines (e.g., diethylamine, dibutylamine, butylamine, and laurylamine) and blocked monoamines (e.g., ketimine compounds).

The urea-modified polyester preferably has typically a weight average molecular weight of 10,000 or more, preferably 20,000 to 10,000,000, and more preferably 30,000 to 1,000,000. When the weight average molecular weight is too small, for example, less than 10,000, the hot offset resistance of the resultant toner deteriorates. The number average molecular weight of the urea-modified polyester is not particularly limited when the above-described unmodified polyester resin is used in combination.

Specifically, the weight-average molecular weight of the urea-modified polyester resins has priority over the number-average molecular weight thereof. When the urea-modified polyester is used alone, the urea-modified polyester preferably has typically a number average molecular weight of 2,000 to 15,000, preferably 2,000 to 10,000, and more preferably 2,000 to 8,000. When the number average molecular weight is too large, for example, greater than 20,000, the low-temperature fixability of the resultant toner as well as glossiness of color images deteriorate.

The combination of the unmodified polyester and the urea-modified polyester enhances the low-temperature fixability and glossiness as compared with a case in which the urea-modified polyester is used alone. The unmodified polyester may include a polyester modified with a chemical bond other than urea bond.

It is preferable that the unmodified polyester and the urea-modified polyester be at least partially compatible with each other from the viewpoint of the low-temperature fixability and the hot offset resistance of the toner. Therefore, the unmodified polyester and the urea-modified polyester preferably have a similar chemical composition.

The weight ratio of the unmodified polyester to the urea-modified polyester is typically 20/80 to 95/5, preferably 70/30 to 95/5, more preferably 75/25 to 95/5, and most preferably 80/20 to 93/7. When the content of a urea-modified polyester is less than 5% by weight, the hot offset resistance of the toner tends to deteriorate, and it is difficult to have a good combination of high temperature preservability and low temperature fixability.

The binder resin of the toner, which includes an unmodified polyester and a urea-modified polyester, preferably has a glass transition temperature (Tg) of from 45° C. to 65° C., and preferably from 45° C. to 60° C. When the glass transition temperature Tg is too low, for example, lower than 45° C., the heat resistance of the toner tends to deteriorate. By contrast, when the glass transition temperature Tg is too high, for example, higher than 65° C., the low temperature fixability of the toner tends to deteriorate.

Because the urea-modified polyester is likely to be present on a surface of the parent toner particles, the resultant toner has better high temperature preservability than known polyester toners, even though the glass transition temperature Tg of the urea-modified polyester is relatively low.

[Colorant]

Suitable materials for use as the colorant of the toner include known dyes and pigments. Specific examples of such dyes and pigments include, but are not limited to, carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

These materials are used alone or in combination. The content of the colorant in the toner is preferably 1% to 15% by weight, and more preferably 3% to 10% by weight.

The colorant can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc.

These resins can be used alone or in combination.

[Charge Control Agent]

Specific preferred examples of suitable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LR1-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

Among the above-described examples, materials capable of negatively charging the toner are preferable.

The content of the charge controlling agent is determined based on the kind of binder resin used, the presence or absence of other additives, and how the toner is manufactured. Preferably, the content of the charge controlling agent is 0.1 to 10 parts by weight, more preferably 0.2 to 5 parts by weight, based on 100 parts by weight of the binder resin, but is not limited thereto. When the content of charge controlling agent is too large, for example, greater than 10 parts by weight, the toner may be excessively charged, hence increasing electrostatic attraction between the toner and a developing roller, resulting in poor fluidity of the developer and low image density.

[Release Agent]

The toner preferably includes a wax having a low melting point of 50° C. to 120° C. as a release agent. Such a wax effectively functions as the release agent at an interface between a fixing roller and the toner when agent when dispersed in a binder resin. Therefore, the toner can be used without applying a release agent such as oils to the fixing roller. With this configuration, the hot offset resistance can be improved without applying a release agent, such as oil, to the fixing roller.

Specific preferred examples of suitable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax); synthetic hydrocarbon waxes such as Fischer-Tropsch wax and polyethylene wax; and synthetic waxes of esters, ketone, and ethers. In addition, synthesized waxes can also be used.

Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-lauryl-methacrylate, and n-stearyl acrylate-ethyl methacrylate copolymers can also be used.

The charge controlling agent and the release agent can be melted and kneaded together with the master batch and the binder resin, or can be added when dissolved or dispersed in an organic solvent.

[External Additives]

As an external additive, a particulate inorganic material is preferably added to toner particles to improve the fluidity, developing property, and charging ability. The particulate inorganic material preferably has a primary particle diameter of 5×10^−3 to 2 μm, and more preferably 5×10^−3 to 0.5 μm. The BET specific surface area of the particulate inorganic material is preferably from 20 to 500 $m^2/g$. The content of the particulate inorganic material in the toner is preferably in a range of from 0.01% to 5% by weight, and more preferably 0.01% to 2.0% by weight.

Specific examples of inorganic fine particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In particular, a mixture of hydrophobized silica fine particles and hydrophobized titanium oxide particles is suitable as a fluidizer.

Specifically, a mixture of hydrophobized silica particles and hydrophobized titanium oxide particles both having an average particle diameter of $5\times10^{-4}$ μm or less can be reliably held on the toner surface with improved electrostatic force and van der Waals force even when the toner is repeatedly agitated in a developing device, thereby producing high-quality image and reducing residual toner particles which are not transferred. When fine particles of titanium oxide are used as the external additive, the resultant toner can reliably form toner images having a proper image density even when environmental conditions are changed.

However, the charge rising properties of the resultant toner tend to deteriorate. Therefore, an additive amount of the titanium oxide fine particles is preferably smaller than that of silica fine particles. However, when the added amount of hydrophobic silica particles and hydrophobic titanium oxide particles is in a range of from 0.3% to 1.5% by weight, higher-quality images can be repeatedly formed without degrading charge rising properties.

A description is now provided of a method of preparing the toner. The following method is a preferable method, but the toner preparation method is not limited thereto.

[Toner Manufacturing Method]

(1) A toner component liquid is prepared by dispersing or dissolving in an organic solvent a colorant, an unmodified polyester, a polyester prepolymer having an isocyanate group, and a release agent.

Preferably, the organic solvent is a volatile solvent having a boiling point less than 100° C., so that the solvent can be easily removed after toner particles are prepared. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. These materials are used alone or in combination.

In particular, aromatic solvent such as toluene and xylene, and chlorinated hydrocarbon such as methylene chloride, 1,2-dichloroethane, chloroform, and carbon tetrachloride are preferably used. The amount of the organic solvent is typically from 0 to 300 parts by weight, preferably from 0 to 100 parts by weight, and more preferably from 25 to 70 parts by weight, based on 100 parts by weight of the polyester prepolymer.

(2) The toner component liquid is emulsified in an aqueous medium under the presence of a surfactant and a particulate resin.

The aqueous medium may include water alone or a mixture of water and an organic solvent. Specific examples of the organic solvent include, but are not limited to, alcohols (e.g., methanol, isopropanol, and ethylene glycol), dimethylformamide, tetrahydrofuran, cellosolves (e.g., methyl cellosolve), and lower ketones (e.g., acetone and methyl ethyl ketone).

The amount of the aqueous medium is preferably 50 to 2,000 parts by weight, more preferably 100 to 1,000 parts by weight, based on 100 parts by weight of the toner component liquid. When the amount of the aqueous medium is too small, for example, less than 50 parts by weight, the toner component liquid is not well dispersed and toner particles having a predetermined particle size cannot be formed. When the amount of the aqueous medium is too large, for example, greater than 20,000 parts by weight, manufacturing cost may increase.

A dispersant such as a surfactant or a particulate resin is added to the aqueous medium to improve the dispersion therein.

Specific examples of the surfactants include, but are not limited to, anionic surfactants such as α-olefin sulfonate and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salts, dialkyl dimethyl ammonium salts, alkyl dimethyl benzyl ammonium salts, pyridinium salts, alkyl isoquinolinium salts, and benzethonium chloride); nonionic surfactants such as fatty acid amide derivatives and polyvalent alcohol derivatives; and ampholytic surfactants such as alanine, dodecyldi (aminoethyl) glycine, and N-alkyl-N,N-dimethyl ammonium betaine.

A surfactant having a fluoroalkyl group can produce the effect even with a small amount. Specific examples of anionic surfactants having a fluoroalkyl group include fluoroalkyl carboxylic acids having from 2 to 10 carbon atoms and their metal salts, di sodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16)ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts.

Specific examples of commercially available cationic surfactants having a fluoroalkyl group include, but are not limited to, SURFLON® S-121 (manufactured by AGC Seimi Chemical Co., Ltd.); FLUORAD FC-135 (manufactured by Sumitomo 3M); UNIDYNE DS-202 (manufactured by Daikin Industries, Ltd.); MEGAFACE F-150 and F-824 (manufactured by DIC Corporation); EFTOP EF-132 (manufactured by Mitsubishi Materials Electronic Chemicals Co., Ltd.); and FTERGENT F-300 (manufactured by Neos Company Limited).

The particulate resins are added to stabilize parent toner particles formed in the aqueous medium. Therefore, the particulate resins are preferably added such that the surface of the toner particles is covered with the particulate resins at a covering rate of from 10 to 90%.

Specific examples of such a particulate resin include, but are not limited to, particulate polymethyl methacrylate having a particle diameter of 1 μm or 3 μm, particulate polystyrene having a particle diameter of 0.5 μm or 2 μm, or particulate poly(styrene-acrylonitrile) having a particle diameter of 1 μm.

Specific examples of commercially available particulate resins include, but are not limited to, PB-200H (manufactured by Kao Corporation), SGP (manufactured by Soken Chemical & Engineering Co., Ltd.), TECHPOLYMER SB (manufactured by Sekisui Plastics Co., Ltd.), SGP-3G (manufactured by Soken Chemical & Engineering Co., Ltd.), and MICROPEARL (manufactured by Sekisui Chemical Co., Ltd.).

In addition, inorganic dispersants such as tricalcium phosphate, calcium carbonate, titanium oxide, colloidal silica, and hydroxyapatite can also be used.

Polymeric protection colloids can also be used as the dispersant in combination with a particulate resin and/or an inorganic dispersant to stably disperse the toner component liquid in the aqueous medium.

Specific examples of such polymeric protection colloids include polymers and copolymers prepared by using monomers such as monomers having a carboxyl group (e.g., acrylic acid, methacrylic acid, α-cyanoacrylic acid, α-cyanomethacrylic acid, itaconic acid, crotonic acid, fumaric acid, maleic acid, and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alkyl ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), amides and methylol compounds thereof (e.g, acrylamide, methacrylamide, and diacetoneacrylamide acids), monomers having a chlorocarbonyl group (e.g., acrylic acid chloride, and methacrylic acid chloride), and monomers having a nitrogen atom or an alicyclic ring having a nitrogen atom (e.g., vinyl pyridine, vinyl pyrrolidone, vinyl imidazole, and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose, and hydroxypropyl cellulose, can also be used as the polymeric protective colloid.

The dispersion method is not particularly limited. Known mixers and dispersing machines such as low-speed shearing type dispersing machines, high-speed shearing type dispersing machines, friction type dispersing machines, high-pressure jet type dispersing machines, and ultrasonic dispersing machine can be used for dispersing the toner component liquid in the aqueous medium. Among these dispersing machines, high-speed shearing type dispersing machines are preferably used in order to prepare a dispersant having an average particle diameter of from 2 μm to 20 μm.

When a high-speed shearing type dispersion machine is used, the rotation speed is not particularly limited, but the rotation speed is typically from 1,000 rpm to 30,000 rpm, and preferably from 5,000 rpm to 20,000 rpm. The dispersion time is not particularly limited, but is typically from 0.1 to 5 minutes for a batch type. The temperature in the dispersion process is typically from 0° C. to 150° C. (under pressure), and preferably from 40° C. to 98° C.

(3) When preparing the emulsion, an amine (B) is added thereto to react the amine with the polyester prepolymer (A) having an isocyanate group.

In this reaction, a crosslinking reaction and/or a polymer chain growth reaction is performed. The reaction time is determined depending on the reactivity of the isocyanate group of the prepolymer (A) used with the amine (B). However, the reaction time is typically from 10 minutes to 40 hours, and preferably from 2 hours to 24 hours. The reaction temperature is typically from 0° C. to 150° C., and preferably from 40° C. to 98° C. In addition, known catalysts can be used in the reaction, if needed. Specific examples of catalysts include, but are not limited to, dibutyltin laurate and dioctyltin laurate.

(4) After the reaction is completed, the organic solvent is removed from the emulsified dispersion (i.e., reaction product), and the resultant particles are washed and dried to prepare toner particles.

In order to remove the organic solvent, the emulsified dispersion is gradually heated while being agitated to form a laminar flow, and then the emulsified dispersion is heated in a certain temperature range while being agitated strongly to remove the organic solvent, thereby forming toner particles having a spindle shape. When a dispersion stabilizer soluble in acids and alkalis such as calcium phosphate is used, the dispersion stabilizer adhered to the toner particles can be removed from the toner particles by dissolving the dispersion stabilizer adhered to the toner particles with an acid such as hydrochloric acid (or an alkali), and then washing the toner particles with water. In addition, such a dispersion stabilizer can be removed by a decomposition method using an enzyme.

(5) Next, a charge controlling agent is attached to the thus prepared toner particles, and a particulate inorganic material such as silica and titanium oxide is added as an external additive to the toner particles, to obtain toner particles.

More specifically, the charge controlling agent and the inorganic particles are externally added to the surfaces of the toner particles by a known method using a mixer or the like.

Accordingly, toner having a smaller particle size and a sharper particle size distribution can be easily obtained. Strong agitation in the solvent removal process makes the resulting particles have a variety of shapes, from a spherical shape to a rugby ball shape. In addition, the surface of the toner particles can also be freely changed between a smooth surface to a wrinkled surface.

Figure 12A:
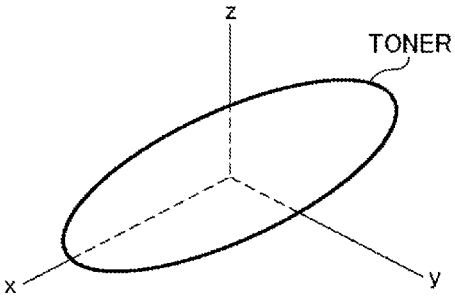
FIGS. 12A to 12C are schematic diagrams illustrating a shape of the toner.
Figure 12B:
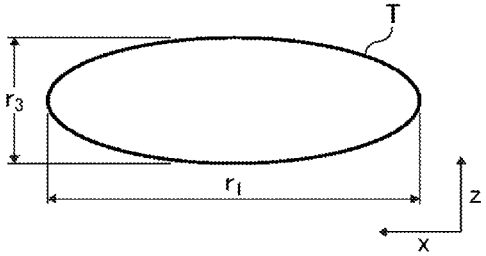
Figure 12C:
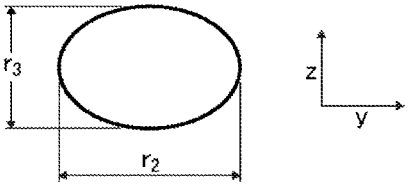

The toner has a substantially spherical shape represented by the following shape factors. FIGS. 12A to 12C are schematic diagrams illustrating a shape of the toner. The toner has a substantially spherical shape with a long axis r1, a short axis r2, and a thickness r3, and the relation of r1≥r2≥r3 is satisfied. With reference to FIGS. 12B and 12C, the toner preferably has a ratio r2/r1 from 0.5 to 1.0, and a ratio r3/r2 of from 0.7 to 1.0.

When the ratio (r2/r1) of the short axis r2 to the long axis r1 is less than 0.5, the shape of the toner is not spherical. Such toner particles cannot produce high quality image because of poor dot reproducibility and poor transfer efficiency. When the ratio (r3/r2) of the thickness r3 to the short axis r2 is less than 0.7, the shape of the toner is nearly flat. Consequently, such toner particles cannot provide high transfer efficiency, which is generally obtained with spherical toner particles. When the ratio (r3/r2) of the thickness r3 to the short axis r2 is 1.0, the toner particles can rotate on the long axis, and therefore the toner has excellent fluidity.

Although the embodiment of the present disclosure has been described above, the present disclosure is not limited to the foregoing embodiments, but a variety of modifications can naturally be made within the scope of the present disclosure.

(Aspect 1)

A cleaning device such as the cleaning device 100 includes a plurality of cleaners such as the cleaning brush rollers including at least a first cleaner, a second cleaner, and a third cleaner arranged next to each other in a traveling direction of a cleaning target such as the intermediate transfer belt 8. The first cleaner is disposed at an extreme upstream end of the traveling direction and supplied with a first voltage having a same polarity as that of a normally-charged toner. The plurality of cleaners other than the first cleaner is supplied with a second voltage having a polarity opposite that of the normally-charged toner.

The polarity of the first cleaning brush roller at the extreme upstream end has the same polarity as the normally-charged toner. The rest of the cleaning brush rollers have the opposite polarity to the polarity of the normally-charged toner. With this configuration, the cleaning performance is enhanced.

(Aspect 2)

According to Aspect 1, the first voltage supplied to the first cleaner such as the first cleaning brush roller 101 is set such that a current equal to or greater than −1 μA and equal to or less than −50 μA flows from the first cleaner to the cleaning target.

With this configuration, as described above, the positively charged toner on the intermediate transfer belt 8 as a cleaning target is attracted electrostatically to the first cleaner at the extreme upstream end, such as the first cleaning brush roller 101.

(Aspect 3)

According to Aspect 1 or Aspect 2, the second voltage supplied to the remaining cleaners such as the second cleaning brush roller 104 and the third cleaning brush roller 107, other than the first cleaner is set such that a current equal to or greater than +1 μA and equal to or less than +50 μA flows from the plurality of cleaners other than the first cleaner to the cleaning target.

With this configuration, as described above, the negatively charged toner on the intermediate transfer belt 8 as a cleaning target is attracted electrostatically to the second cleaning brush roller 104 and the third cleaning brush roller 107.

(Aspect 4)

An image forming apparatus includes a first image bearer such as the intermediate transfer belt 8 to bear a toner image and a test toner pattern on a surface thereof and to travel in a traveling direction, a toner-image forming device (in the illustrative embodiments, the optical writing unit 20, the process units 6Y, 6M, 6C, and 6K, the primary transfer rollers 9Y, 9M, 9C, and 9K) to form the toner image on the surface of the first image bearer, and the cleaning device according to any one of Aspects 1 through 3 to remove residual toner adhered to the surface of the first image bearer.

With this configuration, the toner on the surface of the intermediate transfer belt can be removed well, hence preventing imaging failure caused by cleaning failure.

(Aspect 5)

The image forming apparatus according to Aspect 4 further includes a second image bearer such as the secondary transfer belt 204 onto which the test toner pattern is transferred from the first image bearer such as the intermediate transfer belt 8, and a transfer cleaning device such as the cleaning blade 209 to contact the second image bearer to remove residual toner including the test toner pattern remaining on the second image bearer. The second image bearer is disposed upstream from the cleaning device such as the belt cleaning device 100 in the traveling direction of the first image bearer to contact the first image bearer.

With this configuration, the test toner patterns do not enter the cleaning device such as the belt cleaning device 100, hence preventing cleaning failure of the belt cleaning device 100.

(Aspect 6)

According to Aspect 5, the difference in the linear velocity between the transfer device (the secondary transfer belt 204) and the image bearer (the intermediate transfer belt 8) when transferring the test toner pattern onto the transfer device is greater than during the normal image forming operation.

With this configuration, as described above, the transfer rate is enhanced while reducing the amount of residual toner remaining on the image bearer such as the intermediate transfer belt 8 after the test toner pattern is transferred. With this configuration, the belt cleaning device 100 can remove the toner remaining on the image bearer.

Furthermore, since the difference in the linear velocity is small during the normal image forming operation, the image bearer and the transfer device are prevented from slidably contacting each other, hence reducing or preventing abrasion of the image bearer and the transfer device.

(Aspect 7)

According to any one of Aspect 5 or Aspect 6, a cleaning blade is employed as a transfer cleaning device.

With this configuration, the toner remaining on the surface of the transfer member such as the secondary transfer belt 204 can be removed well.

(Aspect 8)

According to any one of Aspects 4 through 7, the image bearer is an intermediate transfer member equipped with an elastic layer.

With this configuration, the image bearer can change its shape at the secondary transfer nip in accordance with the toner layer and a recording medium having a rough surface. The surface of the intermediate transfer belt 8 can change its shape in accordance with a locally rough surface of the recording medium. With this configuration, the intermediate transfer belt can closely contact the toner layer without applying excessive transfer pressure and can uniformly transfer the toner layer even onto a rough surface recording medium, hence preventing toner dropouts (blank spots) and achieving higher imaging quality.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A cleaning device, comprising:

a first cleaner to receive a first voltage having a same polarity as a polarity of a normally-charged toner, the first cleaner disposed facing a cleaning target;

a first collecting roller to collect toner adhering to the first cleaner;

a first scraping blade to scrape toner adhering to the first collecting roller;

a second cleaner to receive a second voltage having a polarity opposite to a polarity of the normally-charged toner, the second cleaner disposed downstream from the first cleaner in a traveling direction of the cleaning target;

a second collecting roller to collect toner adhering to the second cleaner;

a second scraping blade to scrape toner adhering to the second collecting roller;

a third cleaner to receive a third voltage having a polarity opposite to the polarity of the normally-charged toner, the third cleaner disposed downstream from the second cleaner in the traveling direction of the cleaning target;

a third collecting roller to collect toner adhering to the third cleaner; and a third scraping blade to scrape toner adhering to the third collecting roller.

2. The cleaning device according to claim 1, wherein:

at least one of the first voltage, the second voltage, and the third voltage is supplied to a corresponding one of the cleaners via a corresponding one of the collecting rollers.

3. The cleaning device according to claim 1, wherein:

the normally-charged toner has a negative polarity, and the first voltage is set such that a current in a range from −1 μA to −50 μA flows from the first cleaner to the cleaning target.

4. The cleaning device according to claim 2, wherein:

the normally-charged toner has a negative polarity, and the second voltage is set such that a current not less than +1 μA and not greater than +50 μA flows from the second cleaner to the cleaning target.

5. An image forming apparatus, comprising:

a first image bearer to bear a toner image and a test toner pattern on a surface of the first image bearer and to travel in a traveling direction of the first image bearer;

a toner-image forming device to form the toner image and the test toner pattern on the surface of the first image bearer;

a transfer device to transfer the toner image from the first image bearer onto a recording medium; and the cleaning device according to claim 1 to remove residual toner adhering to the surface of the first image bearer.

6. The image forming apparatus according to claim 5, further comprising:

a first opposing roller opposing the first cleaner, the first opposing roller connected to ground;

a second opposing roller opposing the second cleaner, the second opposing roller connected to ground; and a third opposing roller opposing the third cleaner, the third opposing roller connected to ground.

7. The image forming apparatus according to claim 6, wherein:

at least one of the first cleaner, the second cleaner, and the third cleaner nips the first image bearer for a length longer than a nip portion between the first image bearer and a corresponding one of the first opposing roller, the second opposing roller, and the third opposing roller.

8. The image forming apparatus according to claim 5, further comprising:

a second image bearer onto which the test toner pattern is transferred from the first image bearer, the second image bearer disposed upstream from the cleaning device in the traveling direction of the first image bearer to contact the first image bearer; and a transfer cleaning device to contact the second image bearer to remove residual toner including the test toner pattern remaining on the second image bearer.

9. The image forming apparatus according to claim 8, wherein:

a difference in linear velocity between the first image bearer and the second image bearer upon transfer of the test toner pattern onto the second image bearer is greater than a difference in linear velocity between the first image bearer and the second image bearer upon normal image forming operation.

10. The image forming apparatus according to claim 8, wherein the transfer cleaning device includes a cleaning blade.

* * * * *